US006514185B1

(12) United States Patent
Knuppertz et al.

(10) Patent No.: US 6,514,185 B1
(45) Date of Patent: Feb. 4, 2003

(54) METHOD AND APPARATUS FOR PRODUCING TUBULAR HOLLOW ITEMS

(75) Inventors: Heinz-Werner Knuppertz, Dusseldorf (DE); Michael Heil, Monchengladbach (DE)

(73) Assignee: SIG Combibloc Systems GmbH (DE)

( * ) Notice: Subject to any disclaimer, the term of this patent is extended or adjusted under 35 U.S.C. 154(b) by 0 days.

(21) Appl. No.: 09/381,417

(22) PCT Filed: Mar. 23, 1998

(86) PCT No.: PCT/EP98/01696

§ 371 (c)(1),
(2), (4) Date: Sep. 20, 1999

(87) PCT Pub. No.: WO98/42500

PCT Pub. Date: Oct. 1, 1998

(30) Foreign Application Priority Data

Mar. 21, 1997 (DE) ..... 197 11 799

(51) Int. Cl.[7] ..... B31C 13/00

(52) U.S. Cl. ..... 493/295; 493/296; 493/304; 493/370

(58) Field of Search ..... 493/269, 295, 493/296, 304, 305, 310, 288, 289

(56) References Cited

U.S. PATENT DOCUMENTS 4,870,804 A * 10/1989 Yokoyama
4,908,009 A * 3/1990 Yokoyama
5,492,588 A * 2/1996 Weder et al.

* cited by examiner

*Primary Examiner*—Eugene Kim
(74) *Attorney, Agent, or Firm*—Snell & Wilmer LLP

(57) ABSTRACT

In a method and an apparatus for producing tubular hollow items, in particular for containers, form card material or the like, to improve the efficiency and thus to reduce the costs on the production of known packages, the following steps are proposed: transporting a blank bound by longitudinal edges, or a web of card material or the like, from which the blank is separated into a bending station, the blank or the web being bent by guide elements acting as a bending apparatus and then being held stationary in the bending station and being bent by means of movable bending apparati into the finished shape of the hollow item and an overlap region being formed, in which the two longitudinal edges of the blank, which are parallel to the longitudinal axis of the hollow item, are placed one on top of the other and are connected to one another and the hollow item being conveyed out of the bending station.

20 Claims, 20 Drawing Sheets

METHOD AND APPARATUS FOR PRODUCING TUBULAR HOLLOW ITEMS

TECHNICAL FIELD OF THE INVENTION

The present invention relates to a method and an apparatus for producing tubular hollow items, in particular for containers, from card material or the like.

BACKGROUND OF THE INVENTION

Within the scope of the invention, card material is also understood to mean a flat card which is laminated at least on one side, but preferably on both sides, with a plastic film. In particular, this is PE-coated card. However, the invention also includes all other flat or film-like materials, in particular single or multiple layer plastic films or foldable composite materials with aluminium coating. The plastic lamination is hot bonded or welded after the connection regions of the blank have been placed one on top of the other so that they overlap. When a pure card material is used, a weldable plastic intermediate layer is used in the form of a strip or a bond, for example by means of a hot adhesive or the like.

Methods and apparatuses of the above type are known especially in the production of packages for liquids. In this case, tubular hollow items are produced from a card material, are subsequently closed at one end, filled and, in a final step, also closed at the second end.

In DE-A 22 335 111, for example, a method and an apparatus for winding a multicomponent web to form a cylindrical hollow item from card material is disclosed, according to which the web, unwound from a roll, is partially inserted into a slotted sleeve in which a tube is rotatably arranged as a mandrel and, together with the sleeve, forms a receiving space. By means of a rotational movement, a section of the web is wound around the mandrel in the receiving space and is subsequently conveyed out of the bending station. To increase the efficiency of the apparatus, four slotted sleeves are in use, offset in cycles on a large wheel, as a result of which, however, the apparatus is mechanically complex and the constructional size increases considerably. Moreover, one sleeve remains unused, seen over one revolution of the wheel, by virtue of the principle, which impairs the degree of utilization of the system. Adaptation to cross-sectional areas of the hollow items other than round is also not possible. Furthermore, the apparatus described is used only for producing diaphragms. It does not provide for any connection of the cylindrical hollow item in the overlap region at longitudinal edges of the blank running parallel to one another. Moreover, when using modern packaging materials or coated card materials, on account of sliding friction this apparatus harbours the risk of damaging the coating and further mechanical problems due to the constructional size of the apparatus based on the principle.

A method for the continuous production of tubular packaging items from flat card-material blanks is described in DE 28 50 882 A1. According to this methods, when it runs through a bending apparatus a blank is bent continuously to form a cylindrical hollow item whilst forming a overlap region of the edges of the blank in the direction of transport. The overlap region is provided with an adhesive and, when the hollow item is transported away out of the bending apparatus, it is squeezed together and thus connected. A process of this type based on gradual deformation requires great outlay for transporting apparatuses and a considerable constructional length of the bending apparatus and thus also of the entire device.

GB-A 2 124 140 discloses a method of producing hollow items where blanks are processed by means of movable bending apparatuses while being transported in a bending station. A forming mandrel defines the form of the cross section of the hollow items to be produced. According to the disclosure the hollow items have a rectangular cross section. This method always uses the transfer of the carton blank from a work II to another work station llll to fold a sealing tab preparing the final step of connecting two longitudinal edges. After reaching the final position the bending operation is finished with closing the hollow item around a mandrel. A ultrasonic sealing horn serves as a connection means seaming and sealing the area of connection. This kind, of sealing doesn't protect the cutting edge of the laminated carton blank lying inwardly for a very long time against any kind of moisture occurring from an inner filling of the container during the time of use.

There is a very large requirement for packages which are based on tubular hollow items with a wide variety of cross-sectional areas as a preproduct. The costs for the package now make up a significant portion of the cost of the packaged product. Here, it is precisely those production steps carried out away from the filling operation that make the package considerably more expensive. The object of the present invention therefore consists in providing a method and a compact apparatus with a mode of operation which is as simple and reliable as possible to improve the efficiency and thus to reduce the costs in the production of known packages which are used predominantly for liquids and/or long-life foodstuffs.

According to the invention, a method of producing tubular hollow items having the following steps is proposed:

- transporting a blank, bounded by longitudinal edges, or a web of card material or the like, from which the blank is separated, into a bending station,
- the blank or the web being bent by guide elements acting as a bending apparatus and
- then being held stationary in the bending station and being bent by means of movable bending apparatuses into the finished shape of the hollow item and
- an overlap region being formed, in which the two longitudinal edges of the blank, which are parallel to the longitudinal axis of the hollow item, are placed one on top of the other and
- are connected to one another and the hollow item being conveyed out of the bending station.

The subject-matter of the invention is also an apparatus according to Claim 28 to be preferably applied to carry out the method according to the invention.

The method according to the invention achieves the object set above in that it advantageously combines a continuous bending process with a stationary bending process. In a first step of the method, the blank or a web of card material is bent continuously by means of rigid guide elements when it is introduced into a bending station. When the web has been fixed, a defined section is produced, if the card material is not used in the form of blanks. In both cases, the blank or section is already present and is held stationary in the bending station for further treatment. Movable bending apparatuses then take over the final part of the shaping operation up to the finished shape of the intended hollow item. In this case, an overlap region is formed, in which the two longitudinal edges of the blank, running parallel to the longitudinal axis of the hollow item, are placed one on top of the other and are connected to one another in a final step. The hollow item finally shaped and closed by means of these production steps can then be conveyed out of the bending station Since, in a method according to the invention or in an apparatus constructed for its utilization, the introduction of a blank or a web is also used at the same time for prebending the card material, the operating path of the movable bending apparatuses is small compared to pressers, folding arms and the like, such as are known, for example, from DE-A 25 12 852. Any reduction in movement also reduces the wear on bearings or guides, reduces the consumption of operating auxiliaries, such as for example oils and greases, and also reduces the energy requirement of such a plant.

Furthermore, an apparatus operating according to the method according to the invention is distinguished by a small constructional size, since, in particular due to the superimposition of continuous and stationary shaping, the distances or the radius of movement and the sizes of the parts to be moved are minimized compared to the prior art. The individual steps of the method mesh with one another in an interactive manner and may also be superimposed, so that in total short cycle times can be achieved. An apparatus according to the invention can therefore also be transferred to the filling machine to produce tubular hollow items as a preliminary stage for the production of packaging items. In this case, the card material can be introduced into an apparatus according to the invention either in the form of blanks or as an endless web. The cutting unit, which is superfluous when a blank is used in the apparatus, can then slide or serve to control the dimensional accuracy of the blanks. This does not affect the extended function of the cutting unit, claimed in particular in subclaim 11 with reference to preceding subclaims, during the cutting step.

When it is supplied in the form of an endless web or a prefabricated blank, the card material is precisely positioned at the same time in the plant and is also advantageously already present by means of guide elements. These guide elements are configured in the manner of rails and have a curved section, so that they bend the present material at least partially around a mandrel. The guide elements can thus interact with the mandrel for guiding and shaping. To retain a predetermined precise position, the blank or the web is preferably clamped tightly, preferably using a presser, when it reaches a predetermined insertion length.

The blank transported into the bending station is held tightly there in a stationary manner and without further transportation—as in other known bending and folding devices—is bent or folded around the mandrel at that location to form a tube of the respectively required cross-section by means of movable bending tools, in which case it is placed at least partially against the mandrel. This procedure permits efficient production of the tubular hollow items without considerable space requirement and outlay for machinery. The method according to the invention can therefore readily be arranged upstream of all known filling processes. The incorporation of the method according to the invention into the filling operation permits rapid reaction and adaptation of the package to different requirements, such as in particular changing package sizes and/or equipment variations. Such changes in the type of web or blanks can be carried out virtually without any outage times. For the filling operation, due to the production of the package on site, this opens up new possibilities of requirement-oriented and efficient production.

In a preferred embodiment, the bending is carried out on the present section, with the position being fixed in the apparatus, by means of bending tools which are each rotated about their own attachment points in the bending station. After the step of positioning and cutting of the web, movable bending tools thus take over the further process of shaping the blank. For this purpose, they preferably engage at least partially in a finger-like manner through the stationary elements of the bending station and, in the process, bend assigned parts of the blank.

With the completion of the bending operation, an overlap region is produced by a pressing unit in the region of the longitudinal edges with the bending tools closed. This region is connected in the bending station by being pressed together and preferably welded or bonded, so that the hollow item thus produced is fixed in a sealing manner by welding the seam of the hollow item. Precisely during welding, it is advantageous if at least part of the mandrel is arranged below the overlap region and the pressing or welding unit can thus serve as a counter-piece. For this purpose, according to Claim 7, part of the mandrel is advantageously configured as an anvil part between which and the pressing unit at least one spot-type weld of the overlap region can be carried out. According to Claim 8, this type of permanent fixing is carried out in modern, durable packaging materials, in particular by welding at least one plastic layer or plastic coating present in the overlap region.

During the fixing operation, the movable bending tools can already be opened again since the connecting region between the anvil part and the pressing unit is held securely. The finally shaped hollow item is thus secured against undesirable deviations in shape around the mandrel. By additionally opening the presser and by moving further elements, such as for example an insertion aid, back into their starting positions, a new section or part of a web can already be inserted into the bending apparatus below the hollow item to be fixed or to be welded, that is to say between the mandrel and the guide rails. Thus, in turn, two operations which are separate in terms of the process are superimposed here. Much time and energy can thus be saved, see Claims 9 and/or 10.

In the refinement of the method according to the invention, specific features have to be taken into account for packages. For instance, in the case of plastic-coated liquid packages, and in particular for packages with very long-life moist or liquid contents, it is necessary to protect at least one cut edge of the blank, located on the inside in the finished package, against the ingress of moisture or liquid into the core material. For these particular conditions of use, on packages a so-called bent-over or folded-over seam is preferably used, namely an additional longitudinal edge folded out-wards in the overlap or connecting region. In the case of card material coated with a plastic film on both sides, the longitudinal edge located on the inner side in the overlap region of the later seam is folded over towards the outside of the package and is covered by the longitudinal edge on the outside of the package. In the three-layer arrangement thus formed, the plastic coatings of the individual layers always rest against one another. These plastic layers can advantageously be connected to one another in a sealing manner, for example in a welding operation, without using an additional adhesive or further materials.

Known methods, compare for example DE 35 31 663, for producing a folded-over seam are always constructed in several steps and nevertheless ultimately provide imprecise seam points. In this case, it very often happens that the longitudinal edges of the folded-over seam to be welded are displaced relative to one another, such that the continuity in the design of the package cannot be maintained. In contrast, according to the present invention, a folded-over seam is produced in an efficient and reliable manner with a precise position in the edge region or in a central region. Based on the subsequently described exemplary embodiments, it can be seen that the method according to the invention can also be used for other package and seam shapes and seam arrangements.

According to Claim 11 in the production of a tubular hollow body with a folded-over seam, the material is prefolded during the production of a defined blank in the cutting operation in the region of the cut edge thus produced, in such a way that a first longitudinal edge is already produced here with an additional longitudinal edge prefolded on it. This longitudinal edge is advantageously used, applying a simple toggle lever mechanism, to produce the folded-over longitudinal seam on the package edge or in its central region. According to Claim 12, the additional longitudinal edge is simply formed by the fact that it is bent around a folding edge during the cutting operation by means of a top cutter. The additional longitudinal edge is advantageously determined in its width and area shape by the cross-sectional shape of the top cutter.

Furthermore, both the shaping body or the mandrel and the bending tools are adapted at their contact surfaces, at which they come into contact at least partially with the blank, to the desired final shape of the hollow item to be produced. Complete correspondence is thus not required.

For the method according to the invention and in the apparatus according to the invention, web or blank material with prestamped scoring lines can readily be used. By bending the blank around these scoring lines, very precise folding edges or corners can be produced in a simple bending process. As an alternative thereto, according to a further development of the method according to the invention according to Claim 23, scoring lines are impressed on the card material directly before the cutting operation. At the sites of these scoring lines, the material is prepared in a precisely defined manner so that edges of the later hollow item already form at the scoring lines merely due to the bending of the web or the blank in the stationary guide elements of the bending station. This bending or folding operation can be further reinforced by suitable shaping of the mandrel profile, advantageously also together with the guide elements. Correspondingly, in a method according to the invention, not only hollow items with a circular or oval cross-section, but also those with a triangular, square or rectangular or other polygonal cross-section can be produced efficiently and precisely.

A pressing unit is arranged at the bending station for acting on the overlap region of the three-dimensionally shaped blank. According to the invention, its object is to squeeze together the longitudinal edges of the blank, which are fed precisely on above the other or placed one on top of the other in the overlap region, according to Claims 15–17. By means of a multi-part construction explained below with reference to several exemplary embodiments according to the apparatus Claims 42–48, the pressing unit ensures very precise positioning of the longitudinal edges of the blank both relative to one another and in relation to the mandrel. This advantageously ensures the exact position and precise shaping of the seam on the hollow item to be produced.

According to a further development, the pressing unit is configured as a combination tool in such a way that it can carry out the prescribed positioning and squeezing of the longitudinal edges and produce a sealing weld of the longitudinal edges in the overlap region. Furthermore, the pressing unit comprises a welding tool, preferably in the form of a Sonotrode which is used at the same time as a pressing ram. In an apparatus according to the invention, in the case of a folded-over seam, external fixing and a liquid-tight connection in the overlap region are thus possible in a welding operation by welding the first longitudinal edge to a second longitudinal edge of the blank.

The supply of material can take place in an apparatus according to the invention in a known manner in the form of blanks or from a roll of an endless material web, as already explained above. Adaptation of the apparatus can be carried out quickly by setting up an insertion region on the bending station and different programming of the control. In a particularly advantageous further development, the endless web is removed from a store, for the production of which it is folded in a concertina-like manner. With concertina-like folding or fanfolding, a rectangular outside shape advantageously results for example for a wrapper as external protection and a transport and storage container of the web material. Using ordinary conveying apparatus, such as fork-lift trucks, etc., such wrappers can be transported and also stored more easily, in particular on pallets, than roll material. Moreover, with a fanfold, outer surfaces and inner surfaces of the later package are always in contact with one another respectively. For a hygienically satisfactory package, any transfer of soiling, for example from an outer surface to an inner surface, is thus ruled out. Simple and rapid removal or drawing-off of the web material folded in this manner results, for example, from the fact that the wrapper is opened at a top side parallel to the folded web parts located below. The web can then be pulled continuously out of the wrapper without difficulty in the direction of its longitudinal axis and fed to the bending station. However, a significant factor in the proposed storage or provision of the web material in a fanfold is the fact that, according to Claim 25, the web material is provided with a perforation in each case at the folding edge of the fanfold. During the production of the web material, this creasing region can alternatively also be provided with a semi-cut. By no means of this particular measure which can easily be integrated in the production process, the storage volume of the outer packages can be greatly increased by the higher stacking density of the material, since the creasing region located in each case at the outer edges thus does not curve up in relation to the central regions of the fanfold lying in a stack.

The web material is advantageously fed to the cutting operation directly from a wrapper. This is very simple and space-saving compared to known methods for the charging of apparatuses for the production of packaging preproducts or hollow items. In a further development according to Claim 26, the folding of the web is pulled apart in parts which each correspond to the length of a blank or a multiple of the said length. In this fixed dimension predetermined by the type of package, compact stacks are formed in a fanfold, the creasing region no longer being noticeable in the finished package or the welded hollow item.

A plurality of webs are advantageously arranged adjacently, for example in stacks, in the store or the wrapper. In particular, in this arrangement, a plurality of webs can also be removed simultaneously in parallel from the wrapper.

The applicant reserves the right to establish independent claims for the individual units of the apparatus in which steps of the method described are in each case implemented technically in an innovative manner. It is clear from the preceding description of their respective function that the advantages emerge not only in the interaction of the units in an apparatus according to the invention. On the contrary, the units can also be used advantageously in other machines, for example as a replacement for specific elements of a plant according to the prior art. The content of the claims 2–48 is incorporated herin by reference without repeating the claims.

BRIEF DESCRIPTION OF DRAWINGS

Exemplary embodiments of the invention are explained in greater detail below with reference to the drawing, in which:

FIGS. 6*a*–6*l* show a diagrammatic illustration of the sequence of the apparatus from FIG. 1 in individual steps;

DETAILED DESCRIPTION OF THE PREFERRED EXEMPLARY EMBODIMENTS

Figure 1:
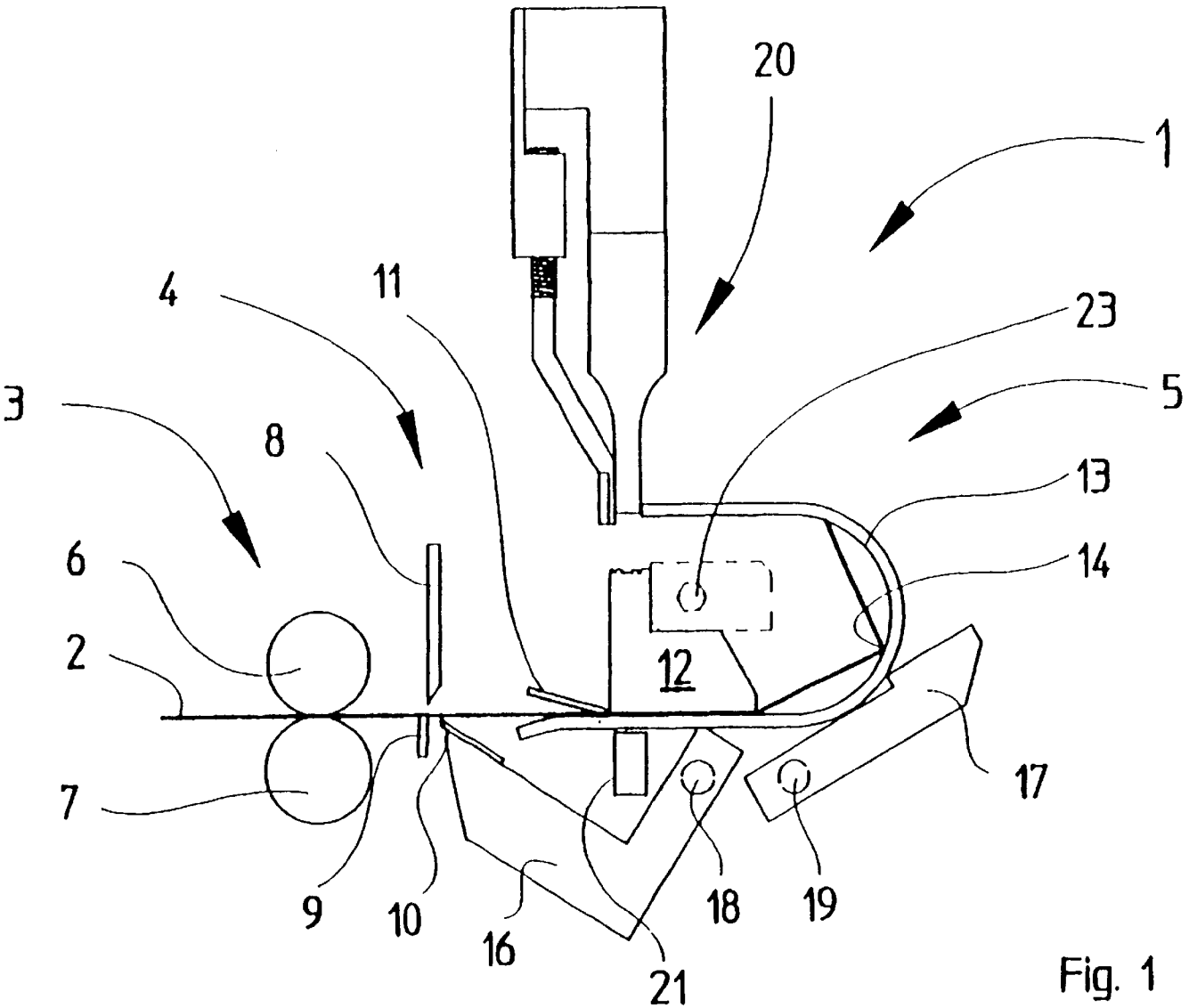
FIG. 1 shows a side view of the principle construction of an apparatus for producing tubular packages in a first embodiment.

FIG. 1 illustrates a first embodiment of an apparatus 1 according to the invention in a side view. In the apparatus 1 illustrated, hollow items with a square cross-section are produced, in which the seam is folded over and the seam point lies along an edge of the hollow item as will be explained.

In the step of the method illustrated, a web 2 of a card material which is PE-coated on both sides is inserted into a bending station 5 by a conveying unit 3 through a cutting unit 4. The conveying unit 3 is configured as a roll or roller drive and comprises a free-running and spring-loaded nipping roll 6 above the web 2 and a driven roller 7 below the web 2. The control of the conveying unit 3 will be detailed below.

The web 2 runs through the cutting unit 4, comprising a top cutter 8 and a bottom cutter 9, in an opened state. In the position illustrated in FIG. 1, a comb-like folding edge 10 is located opposite the top cutter 8 approximately at the same level as the bottom cutter 9. During the cutting operation, the folding comb 10 can be understood as a constituent part of the cutting unit 4 on account of its function which will be described in detail in the description of the operations during cutting.

The web 2, is inserted into the bending station 5 below an insertion aid 11. The bending station 5 comprises fixed and movable parts. In the process step illustrated, the web 2 behind the insertion aid 11 is only in contact with immobile parts. Thus it is transported further on guide rails 13 with the assistance of the insertion aid 11 between a mandrel 12 and the guide rails 13 and, in the process, is bent upwards by a curved section of the guide rails 13 and is thus already partially prefolded.

Scoring lines 14 (not illustrated) have previously been impressed in the web 2. At these scoring lines 14, the web 2 creases in the curved section of the guide rails 13, and the later edges of a tubular hollow item 15 to be produced are already formed here. Without the scoring lines 14, hollow items 15 with a circular or elliptical cross-section can also be produced with or even without a folded-over seam by adaptation of the apparatus 1.

Mounted below the guide rails 13 are two bending tools 16, 17 which are pivotable on axes 18, 19. The tubular hollow item 15 is closed by the bending tools 16, 17 after the cutting operation and is held closed until a pressing unit 20, arranged at the upper end of the guide rails 13, terminates the bending operation and produces the seam on the hollow item 15 .

Also arranged below the guide rails 12 of the bending station 5 is a presser 21 which fixes a blank 22 in its position which blank is obtained during and after the cutting of the web 2. Consequently, the cutting of the web 2 is associated with the production of a prefolded additional longitudinal edge.

The end product produced in the apparatus 1 is then the tubular hollow item 15 which is open at both end faces and is discharged from the mandrel 12 by a slide 23 illustrated by dashed lines in FIG. 1.

Figure 2:
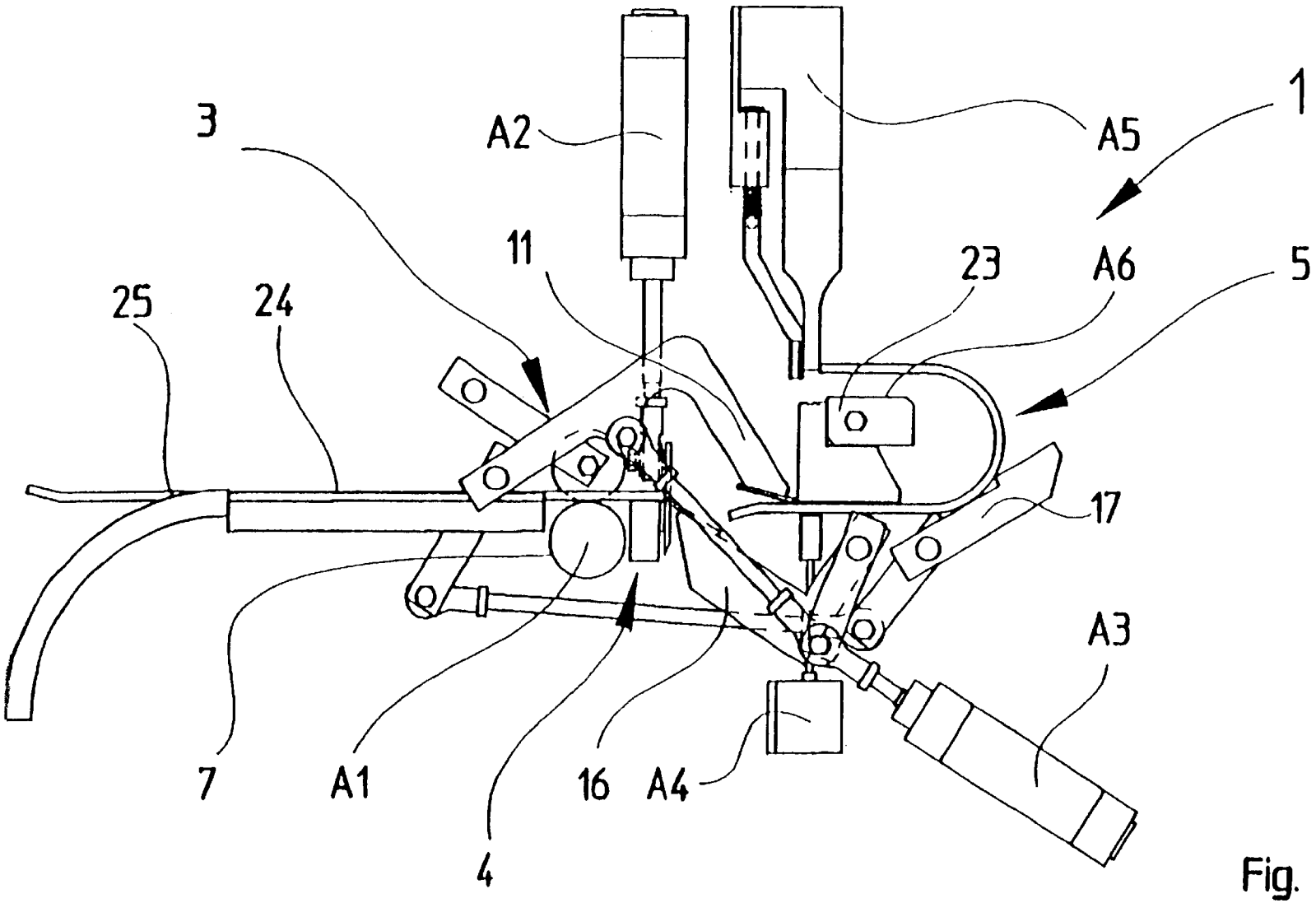
FIG. 2 shows a side view of the apparatus of FIG. 1 with drives, partially in an operating position which is different from that in FIG. 1.

FIG. 2 shows the side view of FIG. 1, taking into account further elements of the apparatus 1. For instance, it can be seen in FIG. 2 that the web 2 is guided over a table 24 with guides 25 to the conveying unit 3 up to the cutting unit 4.

Furthermore, the drives necessary for operating the apparatus 1 in this embodiment are indicated in FIG. 2. The roller 7 is driven by a motor A1, and the cutting unit 4 is driven by a pneumatic drive A2. By means of a lever control, a further pneumatic drive A3 drives essential parts of the bending station 5, namely the insertion aid 11 and the bending tools 16 and 17. The cutting unit 4 can be operated in a cycle together with the presser 21. Here, however, the presser 21 is provided with its own drive A4. A drive A5 of the pressing unit 20 and a drive A6 of the slide 23 are only indicated.

Figure 3:
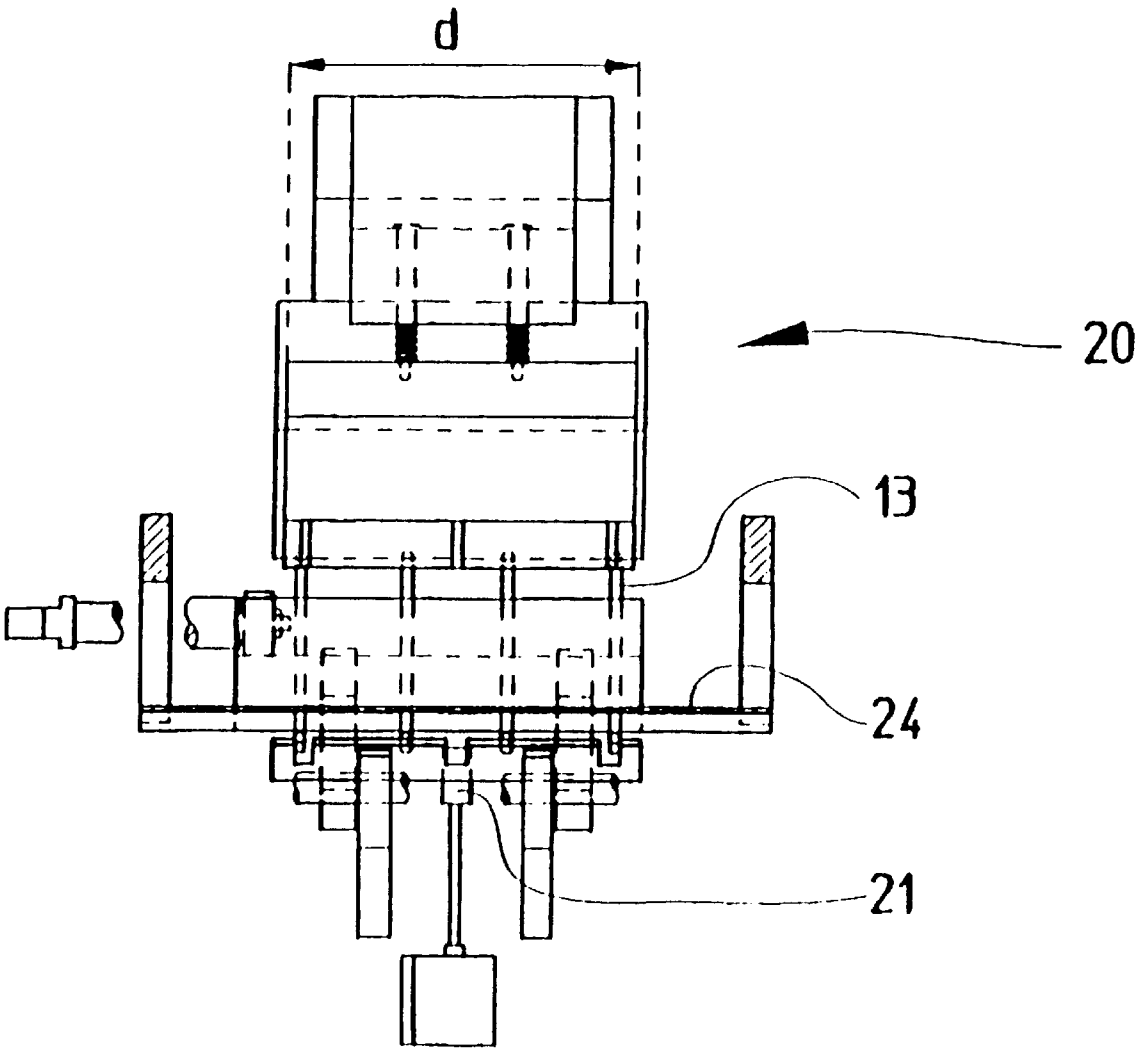
FIG. 3 shows a front view in relation to FIGS. 1 and 2.

FIG. 3 illustrates a front view of the apparatus 1 in the form illustrated in FIG. 2. For reasons of clarity, some of the abovementioned drives and parts have not been illustrated or have been cut. The table 24 in FIG. 3 has been partially cut to give an at least partial illustration of the lever connections.

In the illustration of FIG. 3, the maximum width d of the web 2 to be processed is specified. Indirectly it prescribes the height of the hollow items or packaging preproducts To adapt, for example, to liquid packages with a smaller volume, the width of the table 24 is adjustable by moving the lateral guide 25 (not illustrated here in detail).

Figure 4:
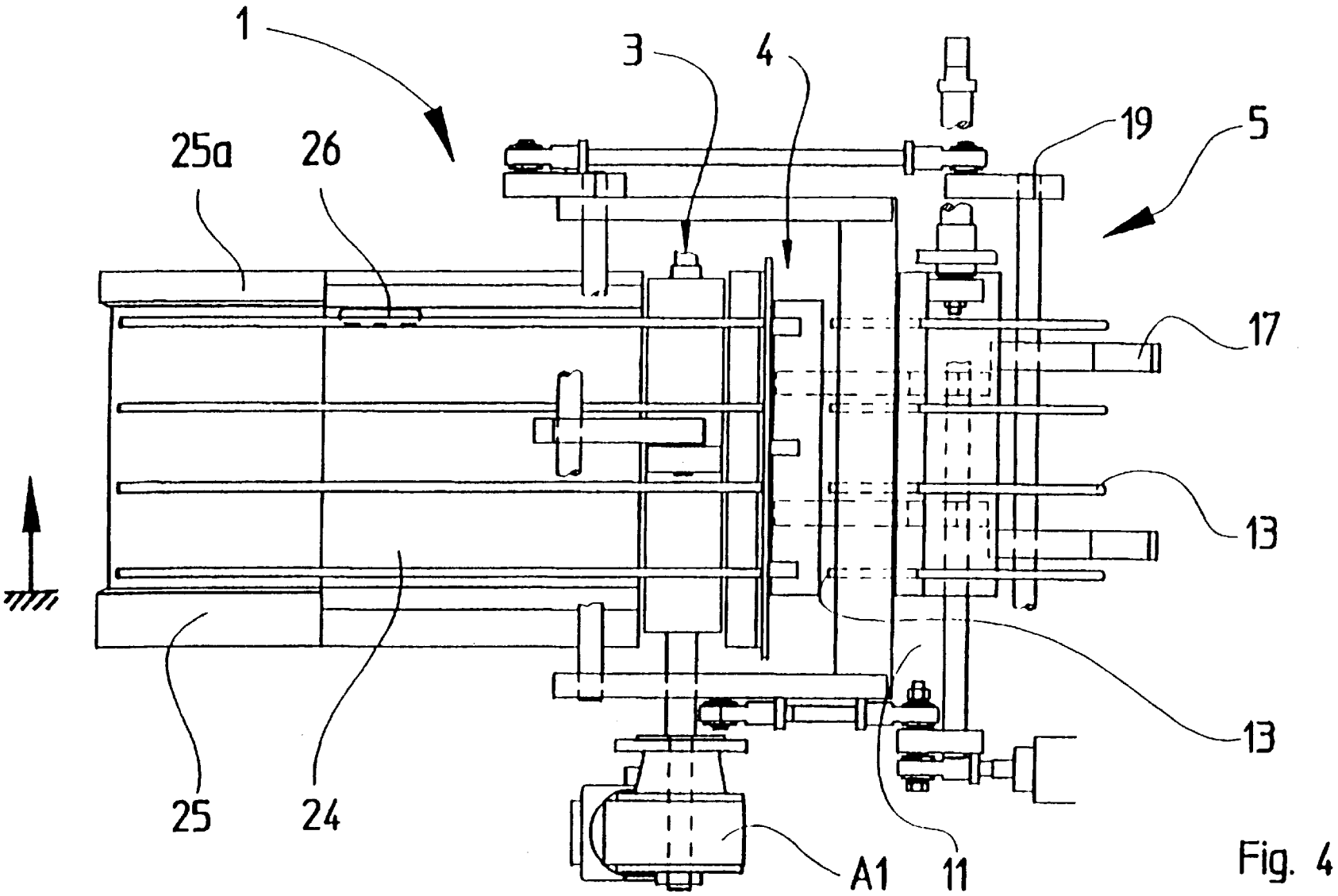
FIG. 4 shows a plan view of a part of the apparatus from FIGS. 1 and 2.

FIG. 4 illustrates the apparatus 1 of FIG. 2 in a plan view, drive elements again having been cut or omitted for reasons of clarity. The table 24 with the guides 25 can be seen in FIG. 4. Indicated on a non-adjustable lateral guide 25*a* of the table 24 is a measuring cell 26 which controls the drive A1 of the conveying unit 3 by optical scanning of reading markers made on the web 2.

Furthermore, the arrangement and the course of individual parts of the bending station 5 can be seen referring to FIG. 4. Thus, for example, the guiding of the inserted web 2 by individual guide rails 13 is illustrated. Furthermore, the finger-like construction of the bending tool 17 is illustrated, where the bending tool 17 in the form of individual levers can be inserted between the guide rails 13 for bending the web 2 by rotation about the axis 19.

In this plan view, the transition region from the table 24 to the conveying unit 3 and cutting unit 4 is also illustrated. From the cutting unit 4, the web 2 is fed into the bending station 5 between the insertion aid 11 and the adjacent ends of the guide rails 13.

Figure 5:
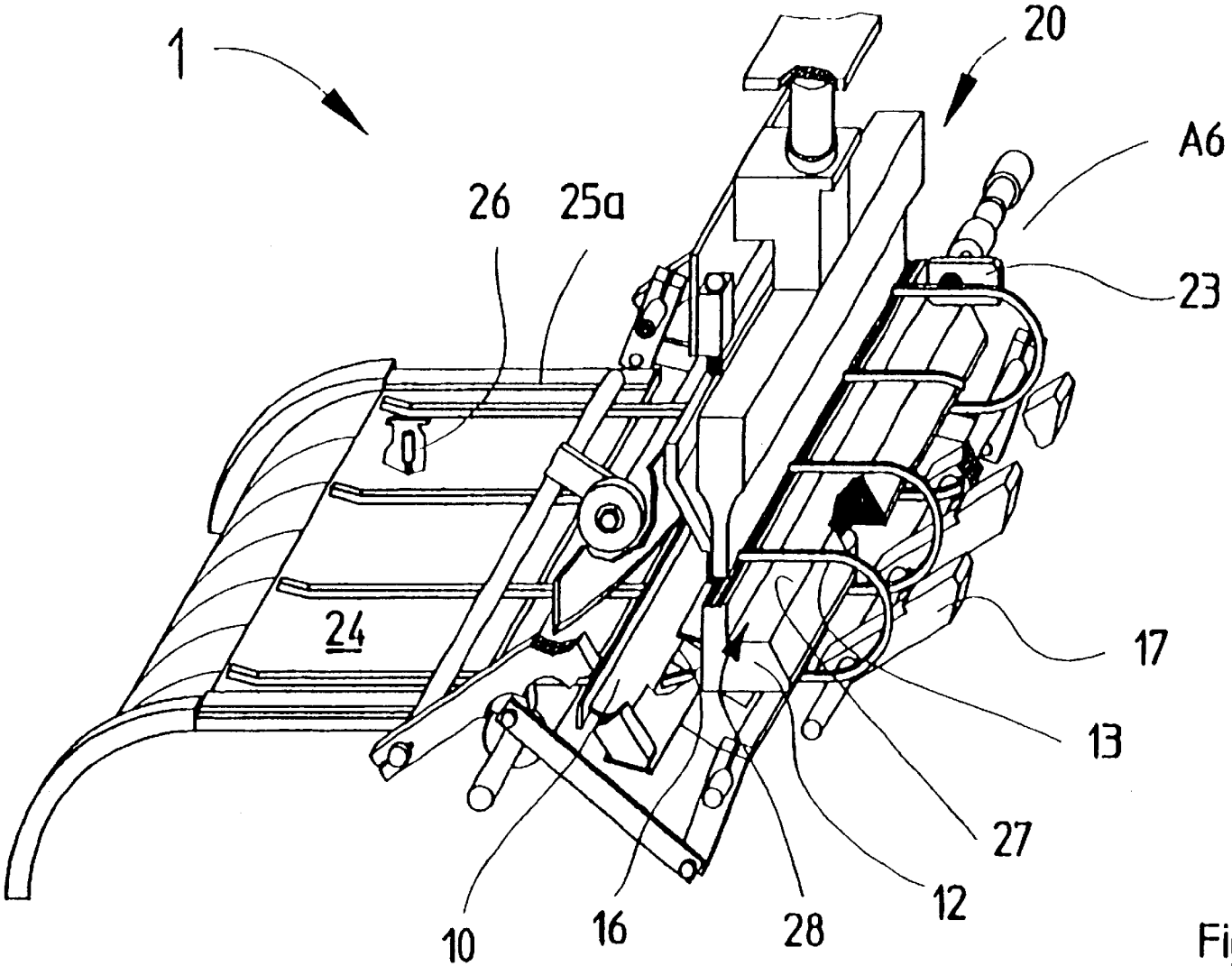
FIG. 5 shows a perspective illustration of the apparatus from FIGS. 1 and 2.

FIG. 5 is a perspective illustration of the apparatus from FIGS. 2 to 4. The measuring cell 26 is illustrated in the region of the fixed lateral guide 25*a* on the table 24. This illustration shows the compact construction of the apparatus 1 with the conveying unit 3, the cutting unit 4 with a folding comb 10, the insertion aid 16, the bending station 5 and the pressing unit 20 arranged above the bending station 5.

The mandrel 12 as part of the bending station 5 has a guide track 27 for the slide 23, illustrated with its drive A6, of a sliding unit 28 and, on the other hand, for an anvil 30. The anvil 30 serves as a counter-piece to the combination tool of the pressing unit 20 which will be described later with reference to FIGS. of several embodiments.

With reference to a sequence of FIGS. based on the construction of the apparatus of FIG. 1, the method of operation and functional sequence of the apparatus during a complete cycle is illustrated below. FIG. 6*a* shows the web 2 which is inserted up to a predetermined length into the bending station 5 between the insertion aid and the guide rails 13 below the mandrel 12. In the situation the measuring cell 26 (not illustrated here) detects a reading marker on the underside of the web 2 and stops the conveying unit 3

Figure 6B:
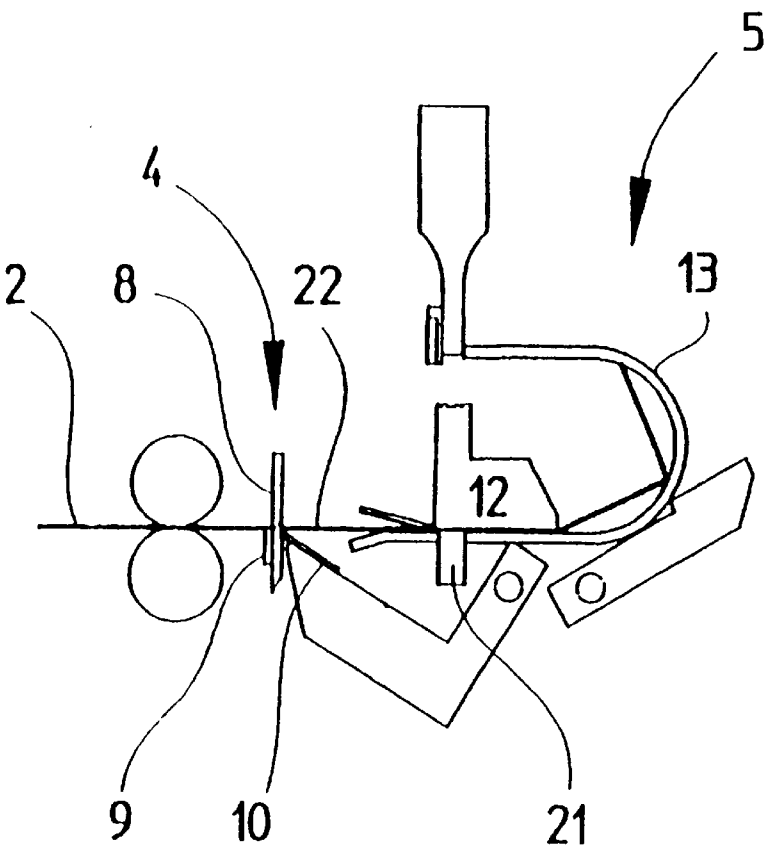
Figure 6A:
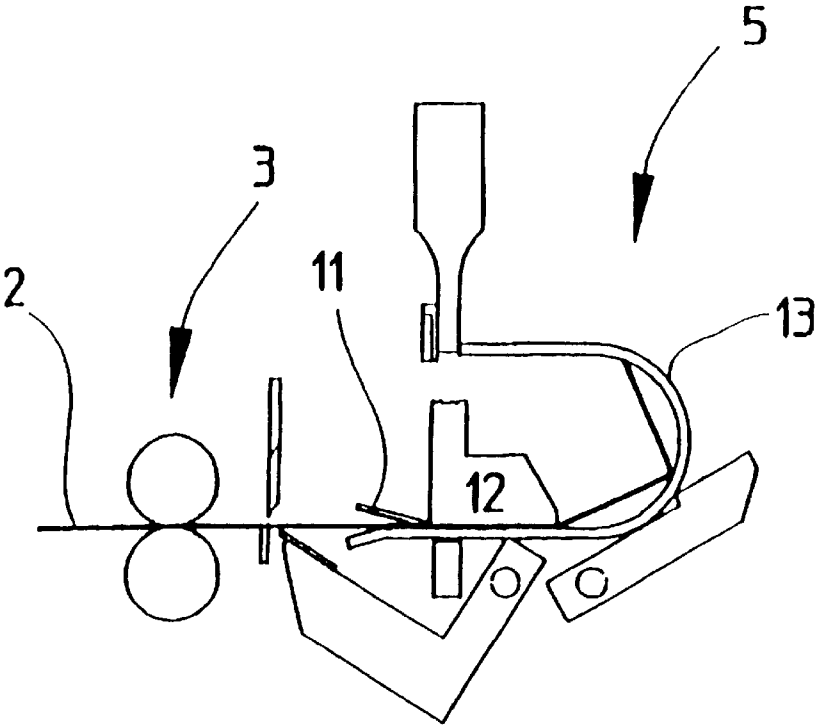

FIG. 6*b* illustrates the next process step in which the cutting unit 4 is closed. In this case, a precisely determined piece is separated from the web 2 and is then further processed as a blank 22 in the bending station 5. For precise adherence of the dimensions of the blank 22, the web 2 is fixed directly before the cutting operation by the presser 21 in that it is clamped from below against the mandrel 12 by the presser 21 between the guide rails 13.

During the cutting operation, the web is separated between a top cutter 8 and a bottom cutter 9, the blank 22 thus produced being prefolded always with the same dimensions by the top cutter 8 at a folding edge 10.

Figure 6D:
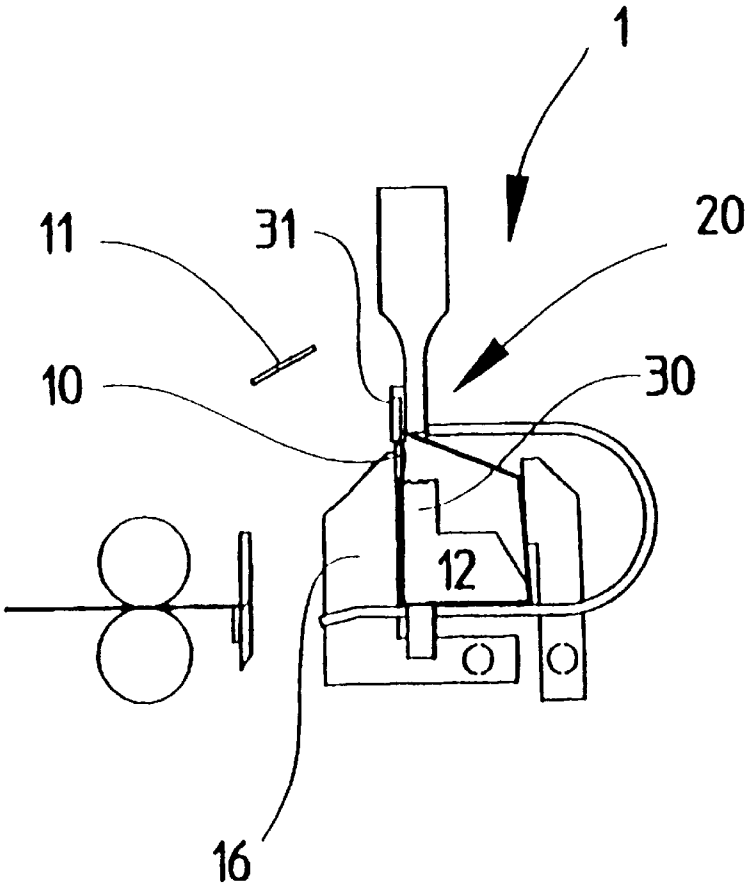
Figure 6C:
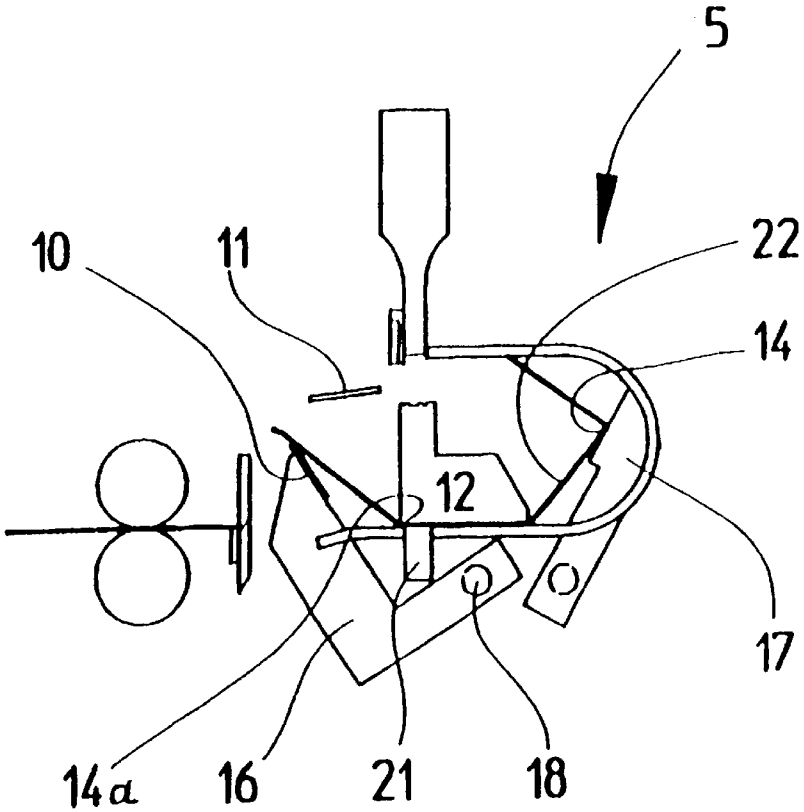

In FIG. 6*c,* the blank 22, which is fixed in its position by the presser 21, is made further into the shape of the tubular hollow item to be produced by the bending tools 16 and 17. To do so, the blank 22 is bent or folded around the mandrel 12 in the bending station 5, the edges of the side walls of the later hollow item being formed at the points of the scoring lines 14.

During this operation, the insertion aid 11 is not used and is therefore moved into a rest position, in which case, at the same time, it frees the space required for the movement of the bending tool 16. In this case, the attachment or axis 18 of the bending tool 16 is offset in relation to the scoring line 14*a,* around which the rear part of the blank 22 is bent, in such a way that, when the bending tool 16 is placed against the mandrel 12, the prefolded region of the blank 22 rests securely with its cut edge against the folding comb 10—with-out protruding.

FIG. 6*d* shows the apparatus 1 in the almost completely closed state. The bending tools 16 and 17 are illustrated in their end position. The blank has already been bent to the extent that the shape intended for the hollow item has already almost been reached. The pressing unit 20 is then lowered from above on to a region of the mandrel 12 configured as an anvil 30. Here it is important to arrange the prefolded region of the first longitudinal edge below the second longitudinal edge. For this purpose, the pressing unit 20 is of two-part construction. As the first part, a comb part 31 is lowered on to the already prefolded region. In this case, the comb part 31 engages in recesses in the folding comb 10 which, is attached to the end of the bending tool 16, thus preventing the longitudinal edge from being trapped during the closing movement described. The comb part 31 is attached in a sprung manner to a welding tool 32, advantageously designed as a Sonotrode. These two parts can thus be moved together as the pressing unit 20 by the drive A5 (not illustrated here).

Figure 6F:
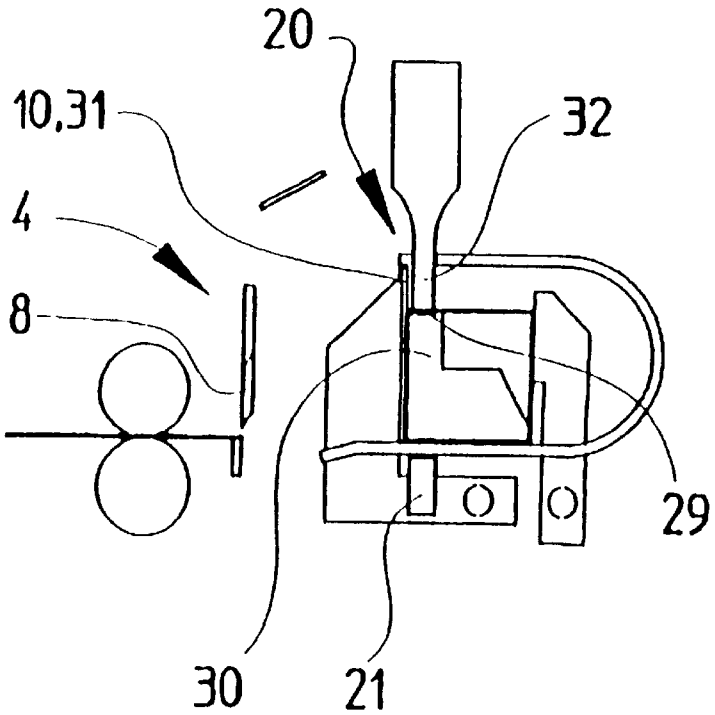
Figure 6E:
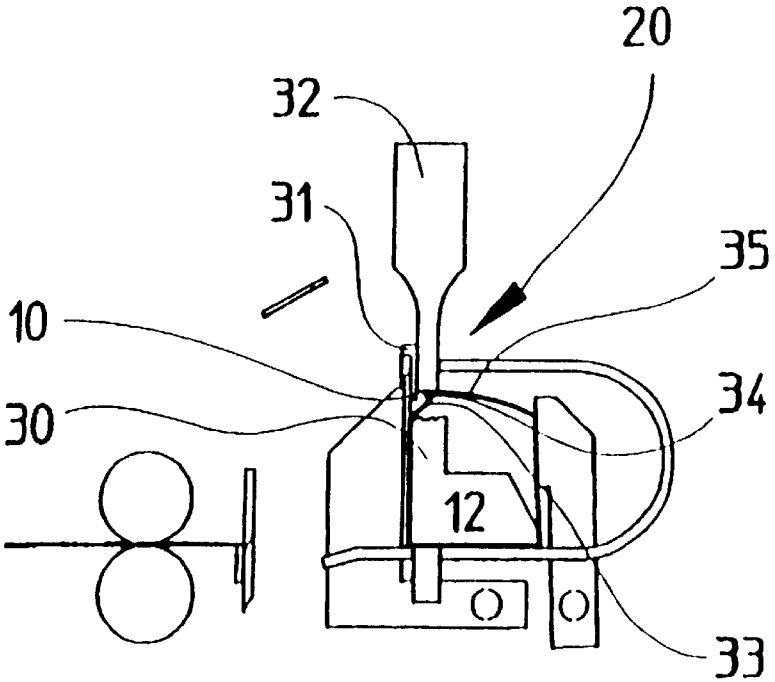

FIG. 6*e* shows the bending and folding operation with the lowering of the fixing unit 20 in its end phase where the later overlap region 29 acting in the way of a simple toggle-lever mechanism. Here the folding comb 10 and comb part 31 mesh with one another and press the first longitudinal edge 33 with the prefold inwards, so that, by the second longitudinal edge 35 being bent over by the welding tool 32, as a result a folded-over corner seam is formed between the welding tool 32 and the anvil part 30 of the mandrel 12, which corner seam is made up of the first longitudinal edge 33, an additional longitudinal edge 34 and a second longitudinal edge 35.

With the transition to FIG. 6*f,* the bending and folding operation is terminated by the complete lowering of the pressing unit 20. In the overlap region 29 of three-layer construction, a folded-over longitudinal seam is welded in the single-stage method illustrated. At the same time, the cutting unit 4 is opened again by raising the top cutter 8, and the presser 21 is lowered to release the clamping on the mandrel In FIG. 6*g,* the welding of the longitudinal seam 36 between the welding tool 32 and the anvil part 30 is continued, while the bending tools 16 and 17 are also being opened again and the insertion aid 11 is being moved back into the position of FIG. 6*a*.

In the position of 6*f* or 6*g* it is possible in a very simple manner to integrate a bad sheet selection as an alternative process step in the apparatus. Therefore if an optical entry control has discovered a faulty blank 22 or a faulty region of the web 2, the bending tool 16 can be held in the position illustrated. With appropriate shaping of the bottom edge of the bending tool 16, the part of the web 2 or the blank 22 introduced into the apparatus can thus be deflected and, for example, conducted out of the apparatus 1 at the bottom. This faulty region thus does not even enter the bending station 5 at all. After the cutting operation, the apparatus 1 is again available as described above.

Figure 6H:
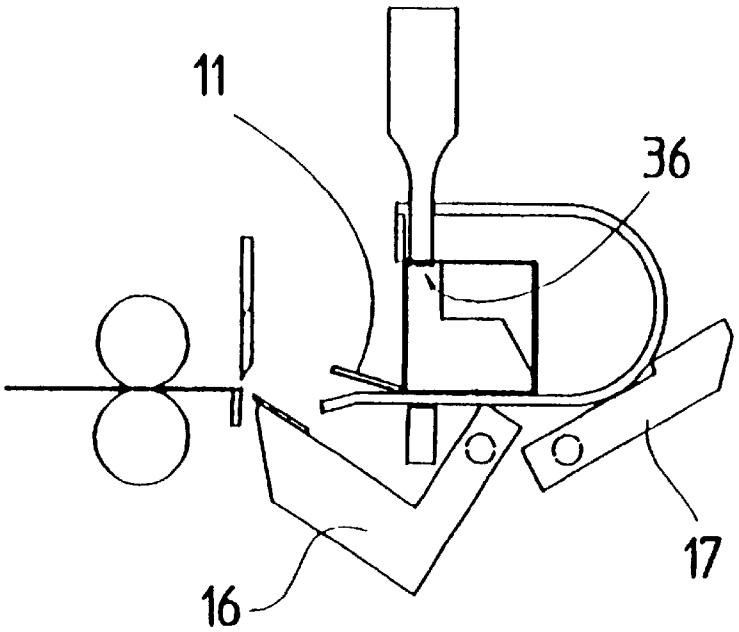
Figure 6G:
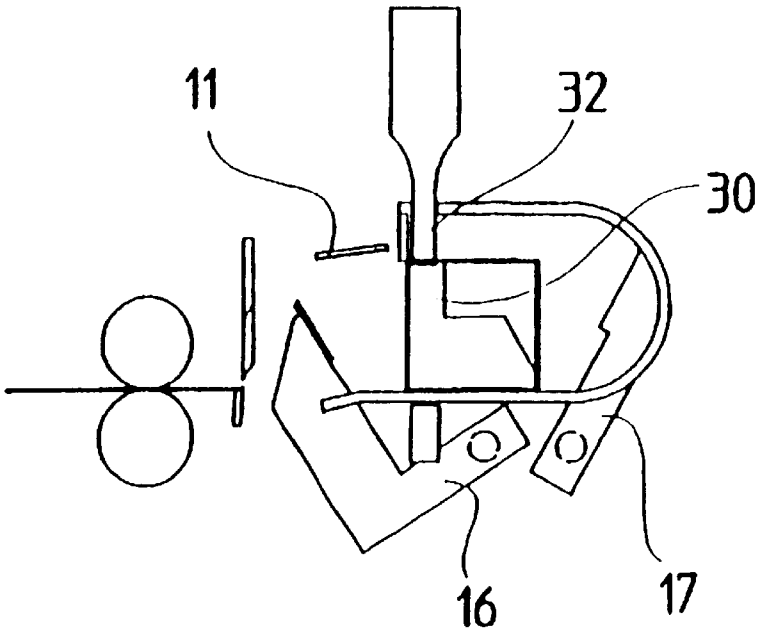

The opening operation is terminated in FIG. 6*h,* and the bending tools 16 and 17 as well as the insertion aid 11 have again reached their starting positions. In this case, the welding operation on the folded-over longitudinal seam 36 is continued.

Figure 6K:
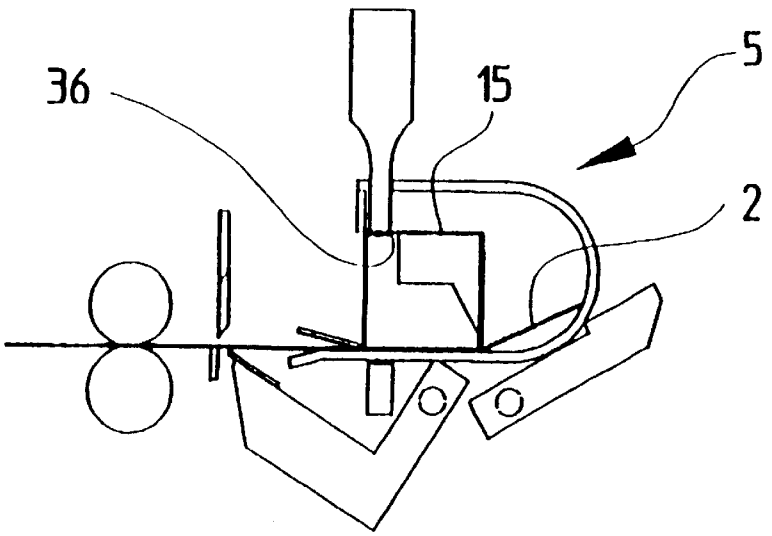
Figure 6I:
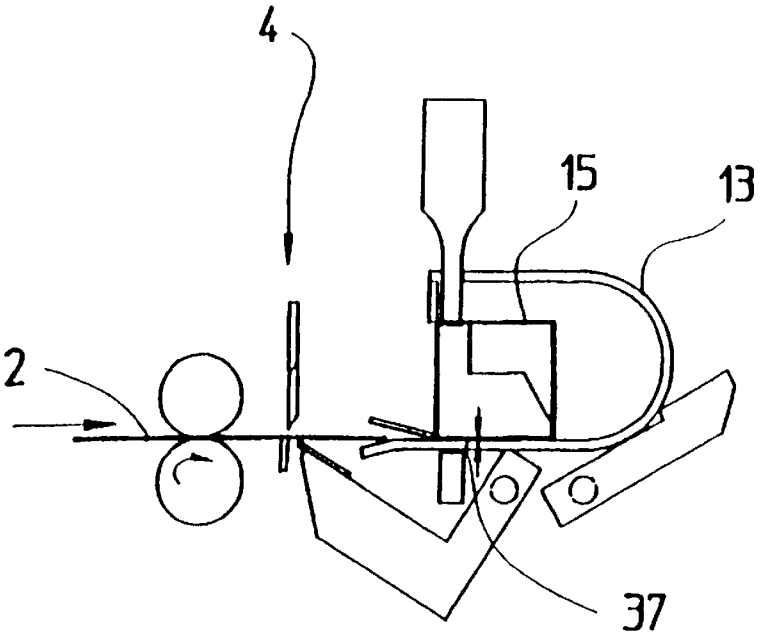

The apparatus 1 is thus prepared for receiving a further section of the web 2 and, as illustrated in FIG. 6*i,* a new section of the web 2 can thus be introduced via the conveying unit 3 through the cutting unit 4 through a passage 37 between the hollow item 15 which is still in the process of welding and the guide rails 13.

FIG. 6*k* illustrates how the web 2 is introduced into the bending unit 5, while the welding or sealing of the longitudinal seam 36 of the hollow item 15 is still taking place, and is already prefolded there.

Figure 6L:
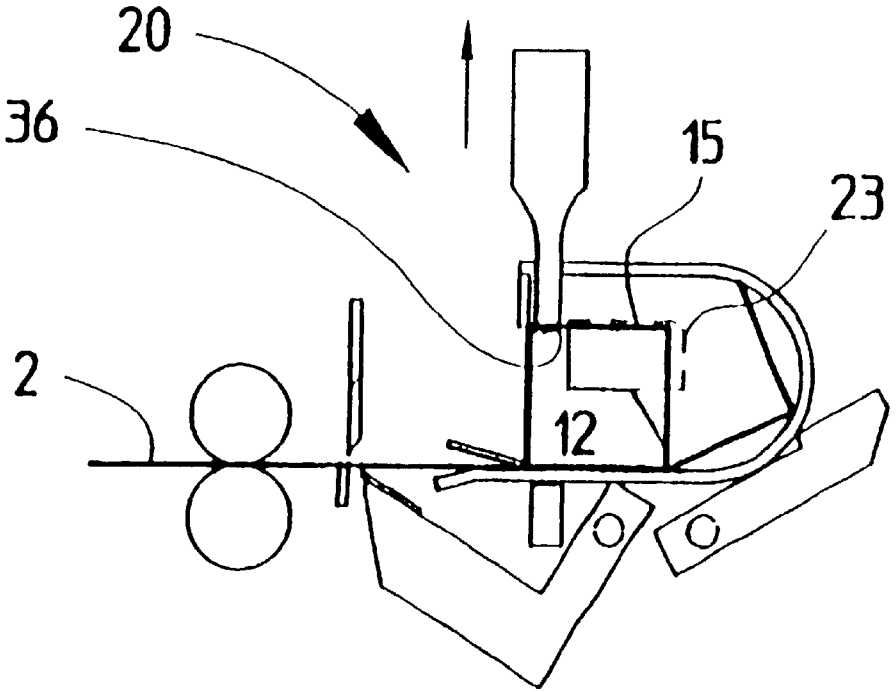

In the process step illustrated in FIG. 6*l,* the welding of the longitudinal seam 36 on the hollow item 15 has been completed. At the same time, the positioning and the measurement of the correct length of the newly introduced section of the web 2 have also ended. The pressing unit 20 is thus lifted up again, as a result of which the now completed hollow item 15 on the mandrel 12 can be moved freely by the slide 15, illustrated by dashed lines, and conveyed out of the apparatus 1. The cycle is thus complete, and the method begins again with the process step illustrated in FIG. 6*a*.

It is clear from the entire sequence of FIGS. 6*a* to 6*l* that the moved parts of the apparatus 1 have to travel short distances. This is achieved, above all, by the fact that the web 2 is already prebent by the round sections of the guide rails 13 when it is inserted into the bending station 5 and is thus kept at a low level in comparison to the plane of the longitudinal seam 36 and is already deflected and fed to this end position.

Figure 7:
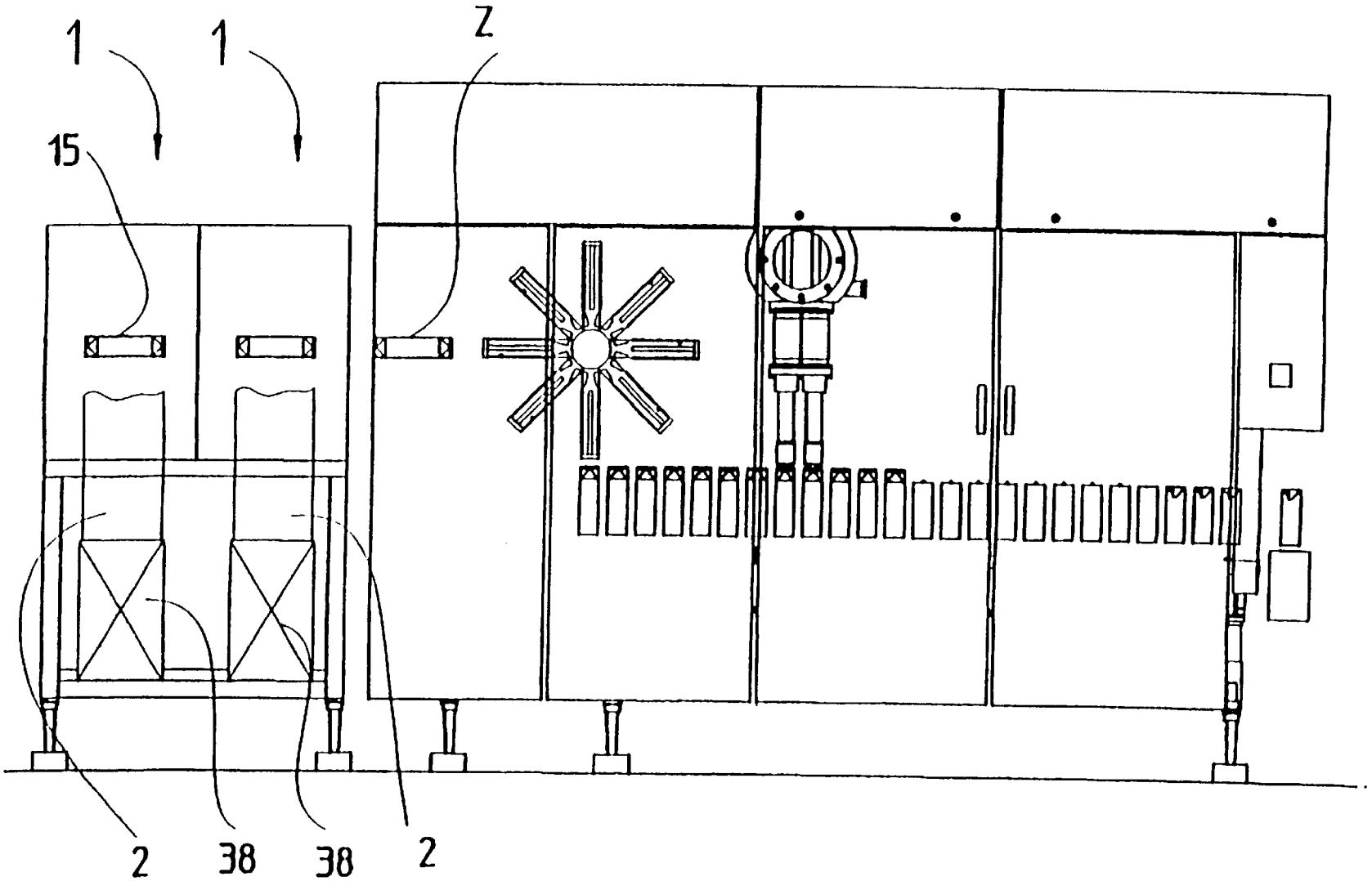
FIG. 7 shows a simplified illustration of a filling machine whose first part comprises an apparatus for producing tubular packages.

FIG. 7 shows a complete machine for filling and packaging liquid media in operation. The first part of the plant illustrated comprises two apparatuses 1 operating in parallel, as has been described above. The apparatuses are illustrated in a simplified form in the drawing. The web 2 is introduced into the apparatuses in each case from a store 38, is cut to size, folded and welded. The finished, tubular hollow items 15 are conveyed in an intermediate step Z towards the right into the actual filling plant, the two-lane filling plant being commercially available in this form and only requiring slight adaptation to the new apparatus 1. Each apparatus 1 thus feeds one lane of the filling machine. However, the apparatus 1 operates, in principle, far faster than the filling machine. The operations within the filling plant itself are known in principle and do not require a description here. The extra costs for the illustrated expansion of the filling machine are compensated after only a short operating period by the reduction in costs for packaging materials.

Figure 8:
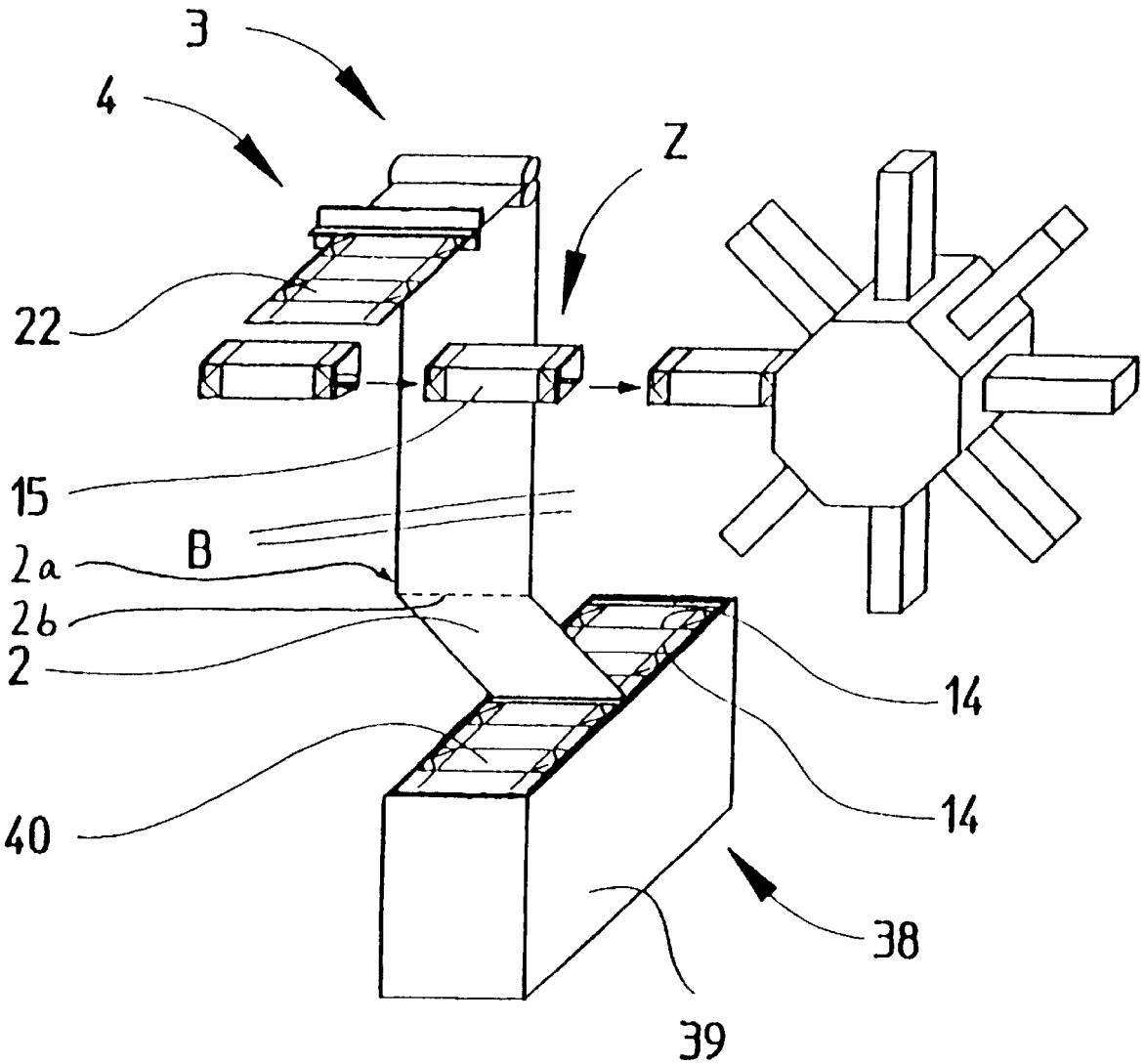
FIG. 8 shows a diagrammatic illustration of individual steps of the processing of web material.

FIG. 8 shows a diagrammatic illustration of the sequence of the method within the apparatus 1 up to transfer of the finished hollow items into the known filling device. Here the web 2, as already illustrated in FIG. 7, is removed from a store 38. In this case the store 38 is a wrapper 39 in which the web 2 is arranged as a stack 40 with a fanfold or with concertina-like folding. The web 2 is produced by a pakkaging material manufacturer with a perforation 2*b* in the creasing region 2*a* of this folding and is placed in the fanfold in the wrapper 39. By means of this perforation 2*b,* which may also be replaced by a semi-cut, the creasing region in the finished fanfold can be folded to be as low as the central region of the fold. Thus any curving-up of the folded creasing regions 2*a* in the wrapper 39 as minimizeded in favor, of an even greater storage capacity with the same outside dimensions. In this case, the wrapper 39 serves at the same time as a transporting and storage container. In addition to the finished printing and coating of the web 2, the scoring lines 14 can also already be impressed on to the web 2 by the packaging material manufacturer. However, if the webs are forwarded to the operator of the apparatus 1 and to the connected filling machine in an unprocessed state in this regard, the scoring lines 14 and further applications, for example so-called pull tabs, can be made on the web 2 at the place marked by B in FIG. 8.

The web 2 runs via the conveying unit 3 to the cutting unit 4. As blanks 22, they are folded in stages to become tubular hollow items is and welded and transported via an intermediate and transporting step Z into the filling machine.

In the manner illustrated, long-term charging of the apparatus 1 is possible without difficulty. In operation, this additionally reduces the personnel costs. Moreover, a rapid and simple exchange of design and even formats can be carried out. When the apparatus 1 is stopped, the web 2 is taken out of the conveying unit 3 and a new web 2 is inserted. The positioning of the new web 2 takes place automatically by means of the conveying unit 3 coupled to the measuring cell 26, such that, due to the precise adherence to the dimensions of the blank, after the first blank no system-related wastage is produced.

Figure 9B:
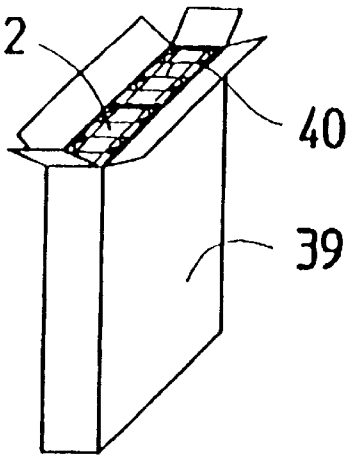
FIGS. 9*a,* 9*b* show perspective illustrations of wrappers for the storage and use of the card material.
Figure 9B:
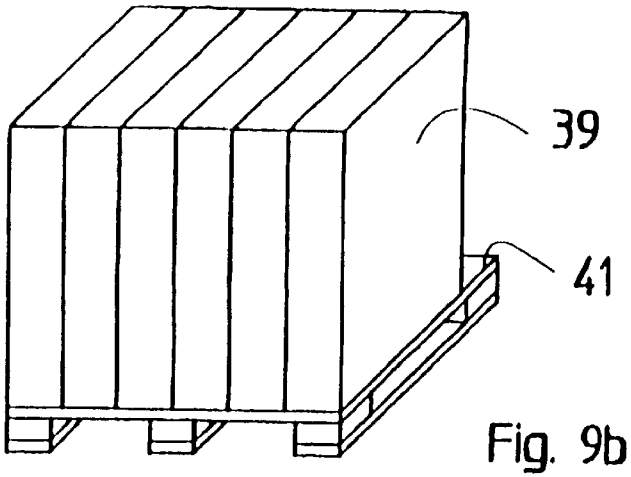
Figure 9A:
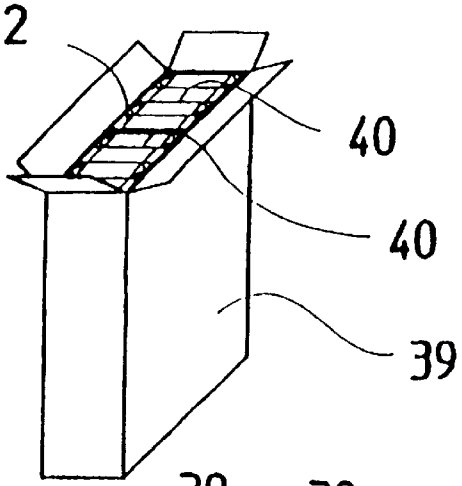
Figure 9A:
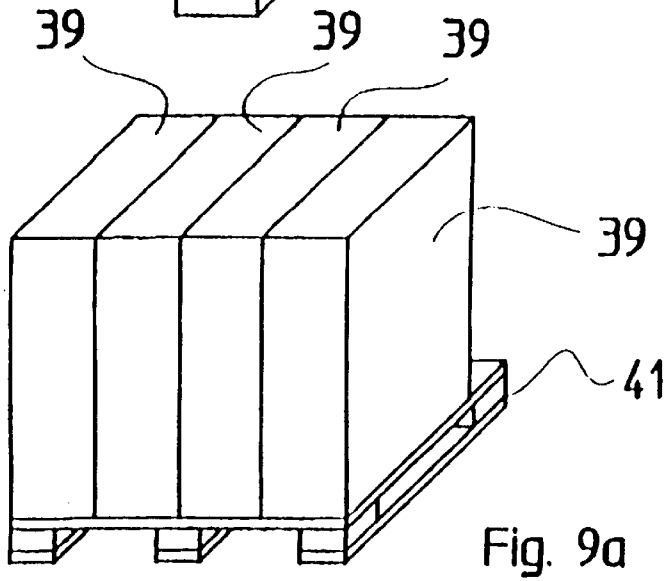

FIGS. 9*a* and 9*b* present, in a perspective view, possible transporting and storage forms of wrappers 39 for fanfolded webs 2 for a different package size. With adaptation to dimensions in transport systems which are common in Europe and worldwide, about 2500 blanks are stored in a wrapper 39 in each case in two stacks 40 arranged adjacently in parallel. The type of storage of the web considerably increases the utilization of space compared to previously known storage methods for tubular hollow items 15. According to a previously common method, only about 600 hollow items 15 can be stored in a wrapper. In the known systems, on the one hand the utilizational volume in the wrappers is far less efficient and, on the other hand, operating personnel are required to load the fillng machines, which means that the weight of the wrappers is limited overall by work safety regulations to less than 10 kg. Since, in the method described, no heavy physical work by operating personnel is necessary to reload individual hollow items 15 or the blanks 22 or here predominantly the webs 2, the weight restriction for the wrappers 39, passed for reasons of work safety, has no significance. The package sizes of the wrappers 39 can thus be freely adapted to the customary standard dimensions in transport systems. This results in total in less problematic storage and more efficient transportation.

A further advantage of the fanfold illustrated consists in the fact that in each case only printed outer surfaces or inner surfaces directed to the side of the later product are in contact with one another. Thus soiling on the inner surfaces can be ruled out.

Furthermore, FIG. 9*a* shows four wrappers 39 arranged on a pallet 41, so that on this pallet 41 alone, webs 2 for about 20,000 hollow items can be stored, transported and positioned in front of or below an apparatus 1. In this example, the hollow items to be produced have a capacity of 1 liter of liquid.

FIG. 9*b* shows, similar to FIG. 9*a,* webs 2 in fanfolded stacks 40 for hollow items which have a 0.5 liter filling volume in a filling machine. In one of the wrappers 39 illustrated, two stacks 40, together comprising 5000 blanks, are arranged in parallel and can be removed at the same time, so that in total 30,000 blanks in the form of webs 2 are available on the pallet 41.

The method described can be varied within broad ranges and can be adapted to different production conditions and cross-sectional shapes of hollow items. Hollow items 15 with a round or oval cross-section can thus be produce analogously by adapting the mandrel 12 and the bending tools 16 and 17 without scoring lines 14 having to be preimpressed on the web 2 or the blanks 22. By making slight changes, hollow items 15 with a rectangular cross-section can also be produced using the apparatus illustrated in FIGS. 6*a* to 6*l*.

An embodiment of the method according to the invention has been described above from the viewpoint of the folded-over corner seam which is to be preferred and is slightly more complex in terms of production. For reasons of continuity of the package design, the folded-over corner seam is preferred today. By folding over the seam in the construction by inserting an additional longitudinal edge 34 on the first longitudinal edge 33 and the overlapping cover by the second longitudinal edge 35, a seam is provided which is permanently strong and is liquid-resistant from the inside and is used, in particular, in foodstuffs with a long shelf life. Here the packaging material of the web 2 is coated with a PE-film on both sides and additionally has a closed aluminium lamination in order to prevent any light and oxygen entering the interior of the package.

Figure 10:
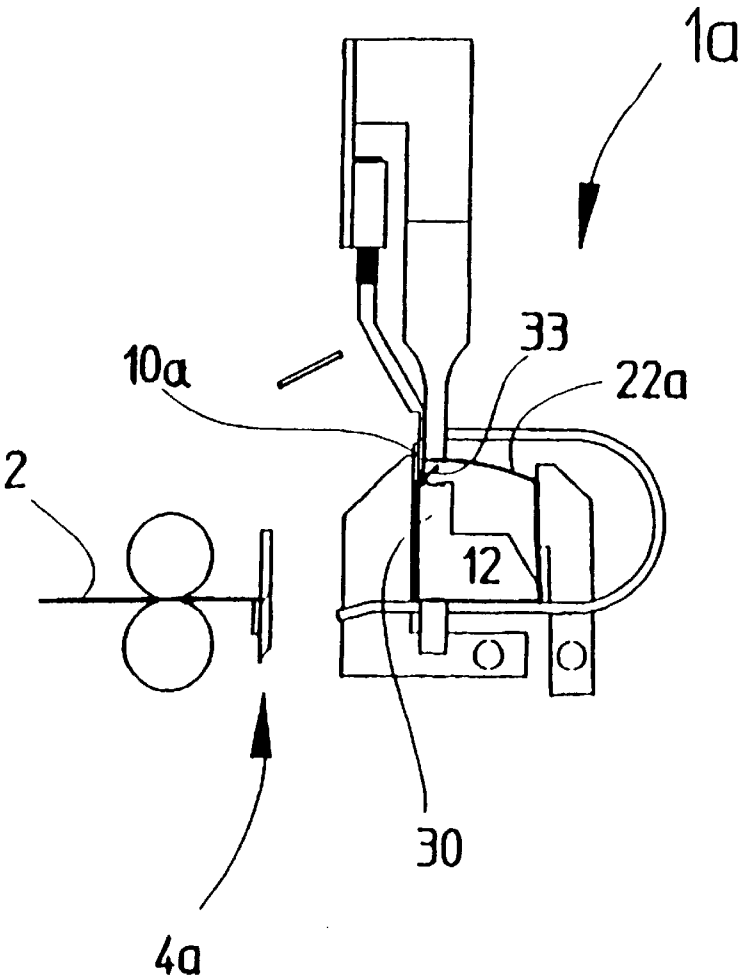
FIG. 10 shows a simplified side view of an apparatus for producing a simple longitudinal seam which is not folded over.

In the sector of packaged foodstuffs with a relatively short shelf life, less complex card materials with simpler welded seams are used. FIG. 10 shows an embodiment of the apparatus 1 for producing a corner seam which is not folded over in the production of tubular hollow items 15. In contrast thereto, the apparatus 1*a* of FIG. 10 comprises a simplified design of a cutting unit 4*a* since, when the web 2 is cut to form a blank 22*a,* no prefolding of an additional longitudinal edge 34 is necessary.

The process step illustrated in FIG. 10 corresponds to that of FIG. 6*e* of the first embodiment. Owing to the lack of an additional longitudinal edge 34 in FIG. 10, the construction of the folding comb 10*a* has to be changed in the manner illustrated in order to fold the first longitudinal edge 33 over in the region around the anvil 30*c* of the mandrel 12.

Figure 11:
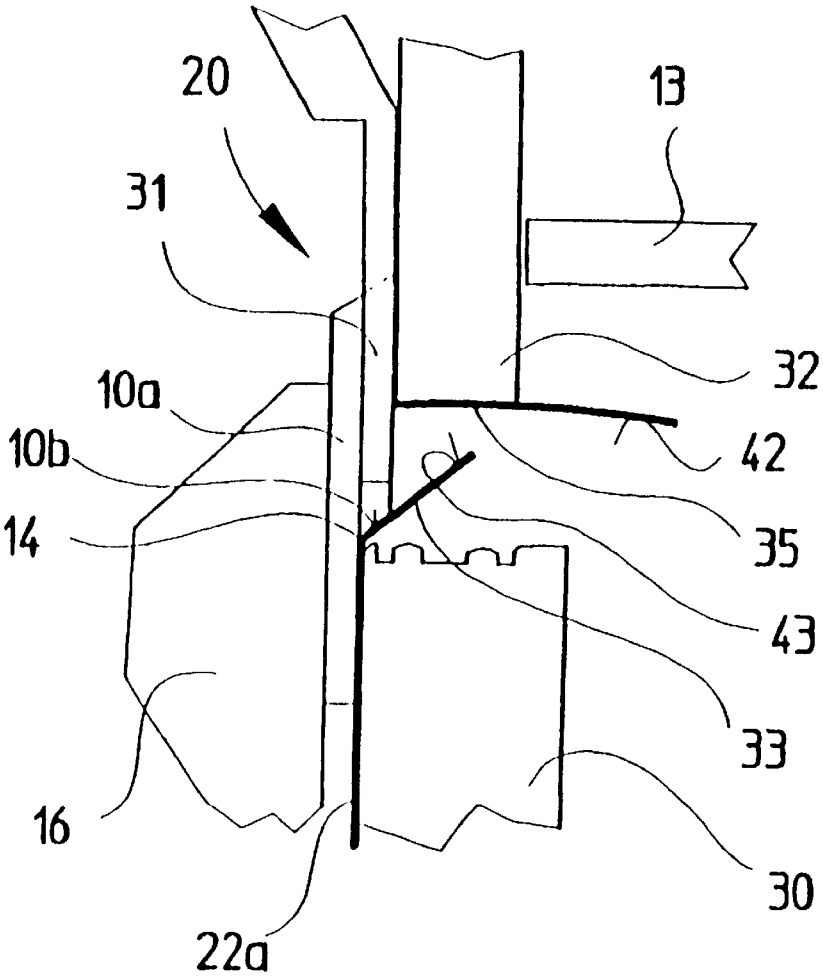
FIG. 11 shows a detail from FIG. 10.

FIG. 11 illustrates a detail from FIG. 10. Here the region around the anvil 30 and the end of the welding tool 32 with longitudinal edges 33 and 35 guided or held between them is illustrated on an enlarged scale. It can be seen that, when the bending tool 16 is closed and the rear end of the blank 22*a* is pressed against the anvil region 30 of the mandrel 12, the first longitudinal edge 33 is bent around the anvil region 30 around a scoring line 14 by means of an additional folding edge 10*b* on the modified folding comb 10*a*. The first longitudinal edge 33 thus lies below the second longitudinal edge 35 prior to the final lowering of the pressing unit 20, and inner and outer plastic coatings 42 and 43 can be pressed one on top of the other and welded by the welding tool 32 on the anvil 30.

Figure 12:
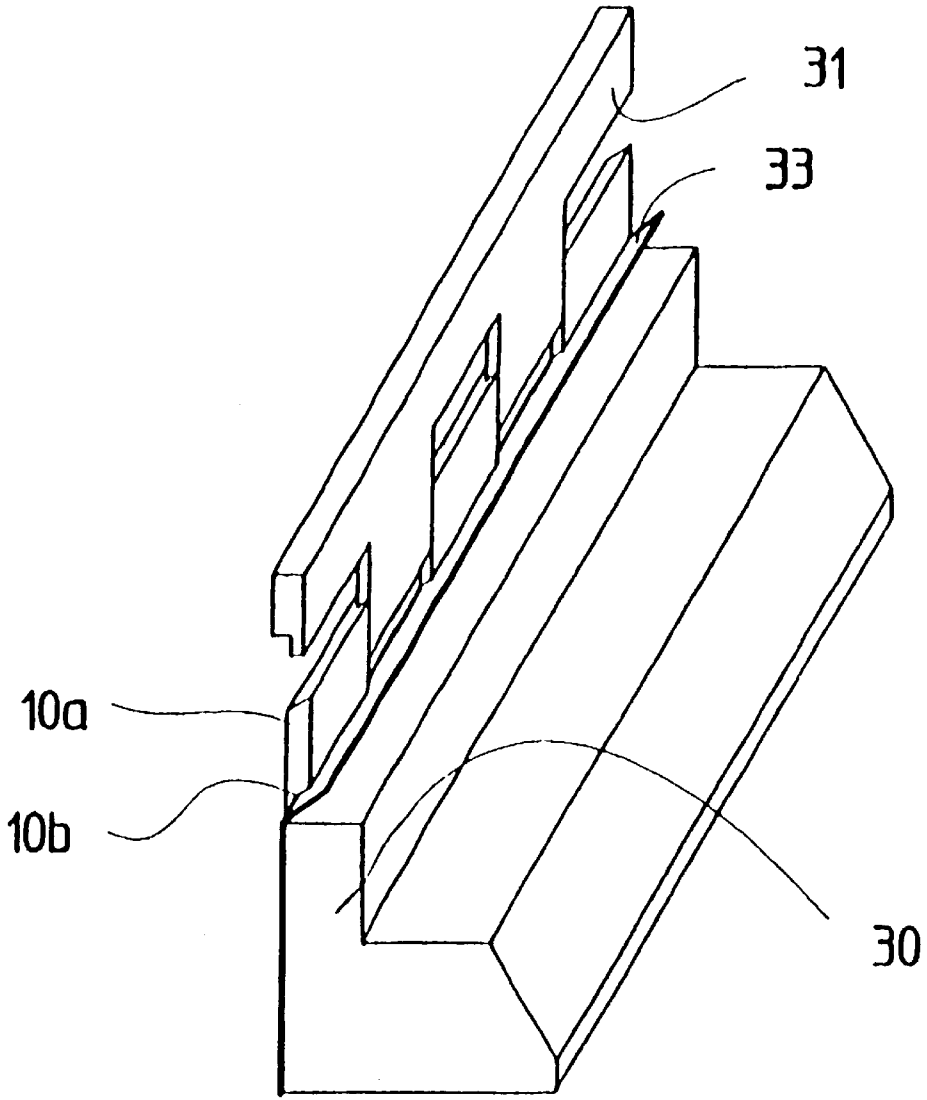
FIG. 12 shows a perspective illustration of a part of a pressing tool from FIG. 10 and FIGS. 13*a*–13*g* show a diagrammatic illustration of the sequence in an alternative apparatus for carrying out the method.

FIG. 12 shows the position from FIG. 11 in a three-dimensional illustration. The bending tool 16 is already completely closed, so that the folding edge 10*a* rests against the mandrel 12, and the first longitudinal edge 33 is bent around the anvil 30 by the edge 10*b*. Furthermore, it can be seen here how the comb part 31 of the pressing unit 20 engages in the grooves or comb structure of the folding comb 10*a*. By means of the comb structure, it is ensured preferably in every embodiment of the invention that neither the first longitudinal edge 33 nor the second longitudinal edge 35 nor the additional longitudinal edge 34 (not present in the exemplary embodiment of FIGS. 10 to 12) can be trapped and thus destroyed between the folding comb 10 or 10*a* and pressing unit 20 when the pressing unit 20 is lowered.

Figure 13A:
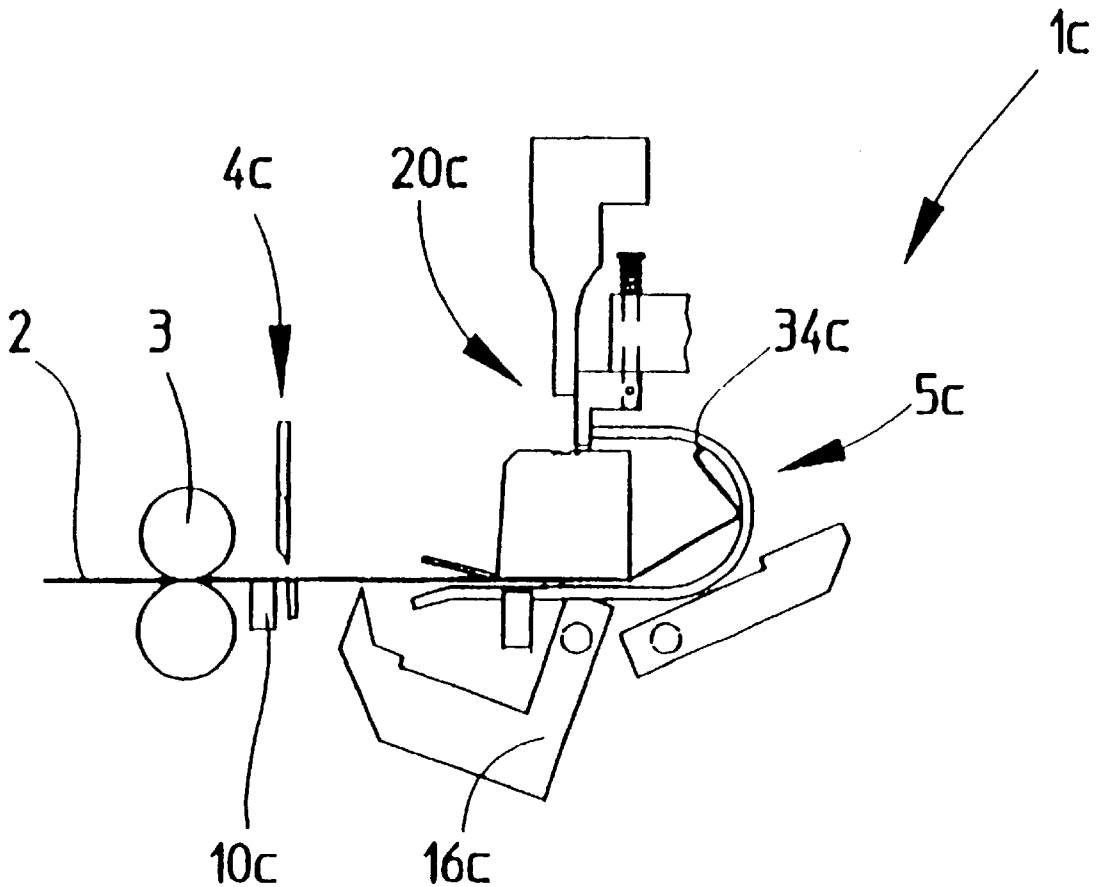

FIG. 13*a* shows a further embodiment of an apparatus 1*c*. Here a folded-over seam in a central region of a tubular hollow item 15 is produced from blanks 22*c* separated from a web 2. To do so, alternative embodiments of a cutting unit 4*c,* the bending tools 16*c,* 17*c* and the pressing unit 20*c* are configured as illustrated in FIG. 13*a*.

In the sequence of FIGS. 13*a* to 13*g,* the sequence of the method is illustrated below similar to FIGS. 6*a* to 6*l*. In terms of the process step, FIG. 13*a* corresponds to FIG. 6*a*. Here the web 2 is inserted by the conveying unit 3 into a bending station 5*c* and is prefolded. However, at the leading end of the web 2*a,* in contrast to the first embodiment of FIG. 6*a,* an additional longitudinal edge 34*c* has already been prebent here.

Figure 13C:
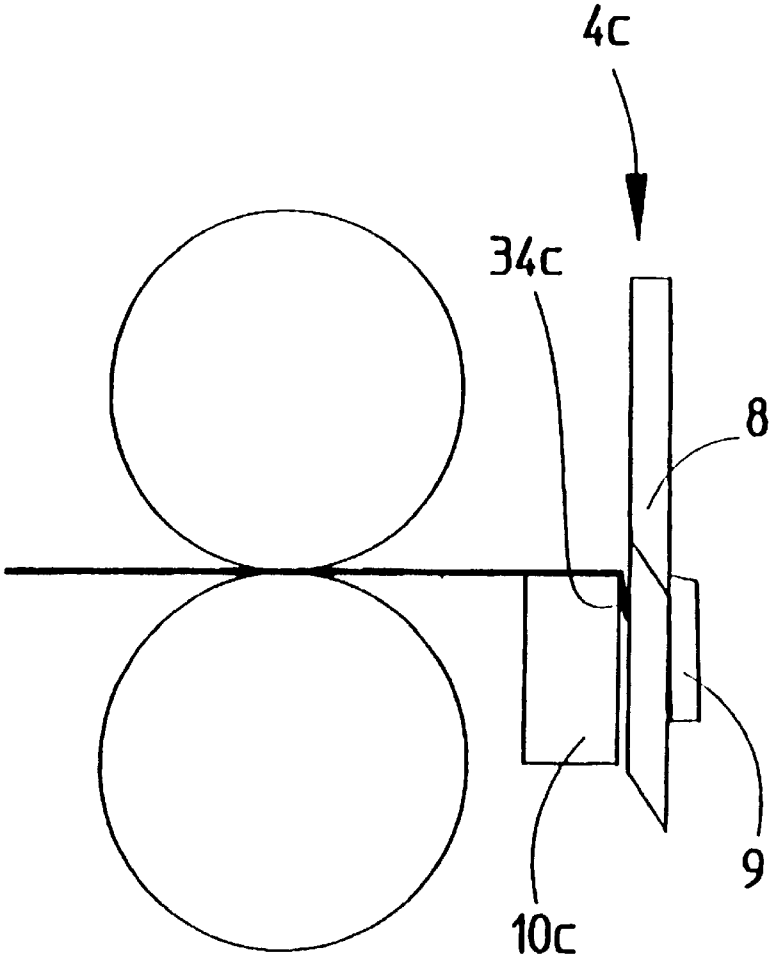
Figure 13B:
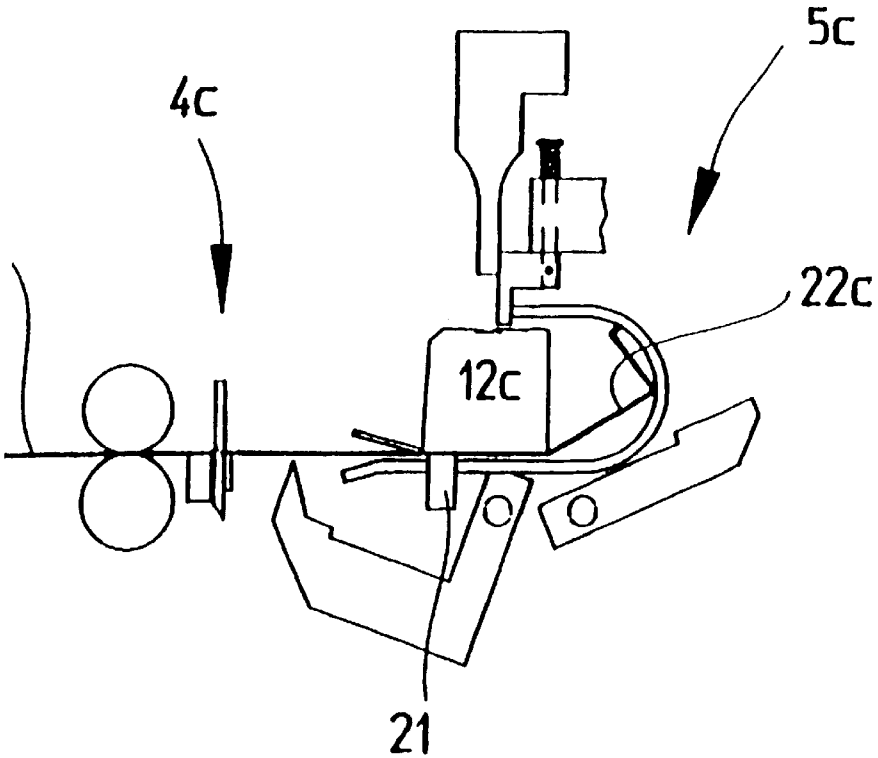

FIG. 13*c* is a momentary image of the cutting operation in which the blank 22*c,* thus positioned in the bending apparatus 5*c* and clamped tightly against the mandrel 12*c* by the presser 21, is separated from the web 2 by the cutting unit 4*c*.

FIG. 13*c* shows the conveying unit 3 together with the cutting unit 4*c* in an enlarged illustration. From this figure it can be seen that the cutting unit has been modified compared to the first embodiment in such a way that a folding edge 10*c* is arranged in each case on the first longitudinal edge of a blank. For transporting the additional longitudinal edge 34*c* beyond the bottom cutter 9, it is possible either to lift the longitudinal edge 34*c* up or to move the bottom cutter 9.

Figure 13E:
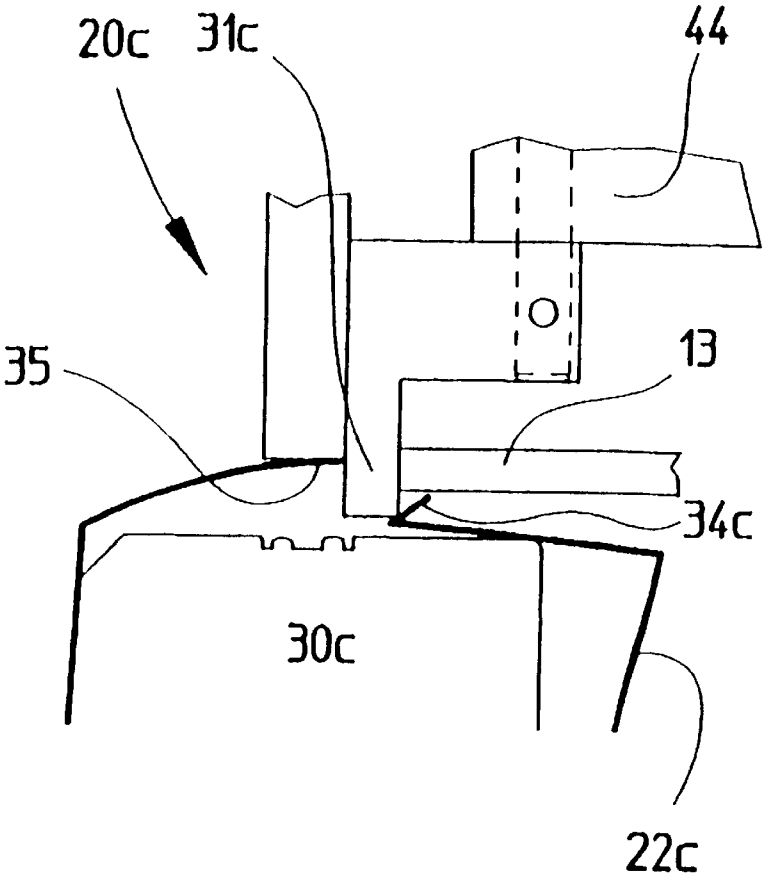
Figure 13D:
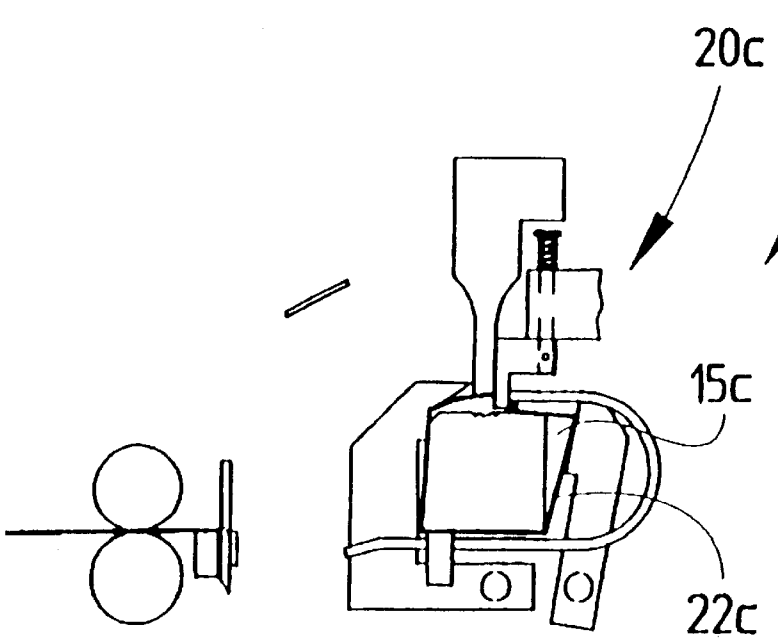

The illustration of FIG. 13*d* corresponds to that of FIG. 6*e* in the first embodiment and illustrates the almost completely closed bending station 5*c* with a tubular hollow item 15*c,* formed from the blank 22*c,* contained therein.

In an enlarged illustration of the pressing unit 20*c* from FIG. 13*d,* the sequence of bending and folding directly before the pressing unit 20*c* is closed is illustrated in FIG. 13*e*. The additional longitudinal edge 34*c* is moved, in the prefolded form, by the guide rails 13 below a comb part 31*c* of the pressing unit 20*c* in such a way that it is positioned in its prefolded state below the second longitudinal edge 35. The comb part 31*c* takes over this function in that it immediately engages in a leading manner with the additional longitudinal edge 34*c* in the region of the ends of the guide rails 13. The comb part 31*c* is thus arranged, disconnected from the welding tool of the pressing unit 20*c,* on a holder 44 so as to be lowerable downwards.

When the bending apparatus 5*c* is closed, the second longitudinal edge 35 strikes with its cut edge against the comb part 31*c* and is conducted downwards by the welding tool 32. In the process, the second longitudinal edge 35 is positioned precisely.

The force for pressing the comb part 31*c* is transferred by the welding tool 32 on to the comb part 31*c* by the fact that, when it is lowered on to a part 45 of the comb part 31*c,* it presses against a restoring spring 46 and thus presses the comb part 31*c* down on to the blank 22*c*.

Figure 13G:
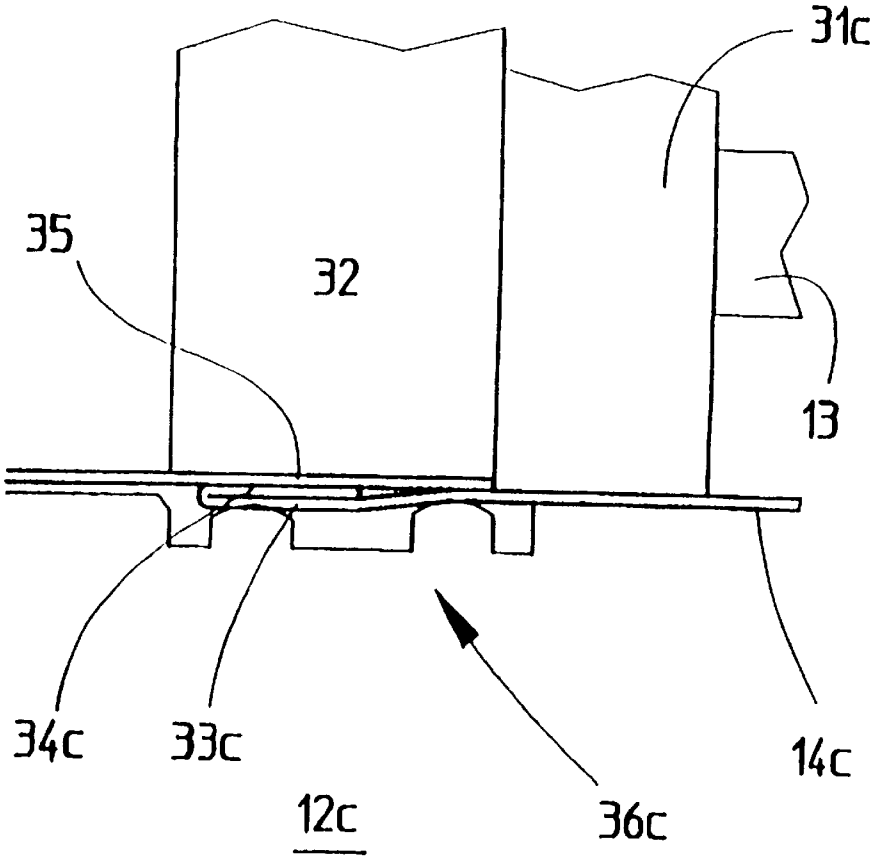
Figure 13F:
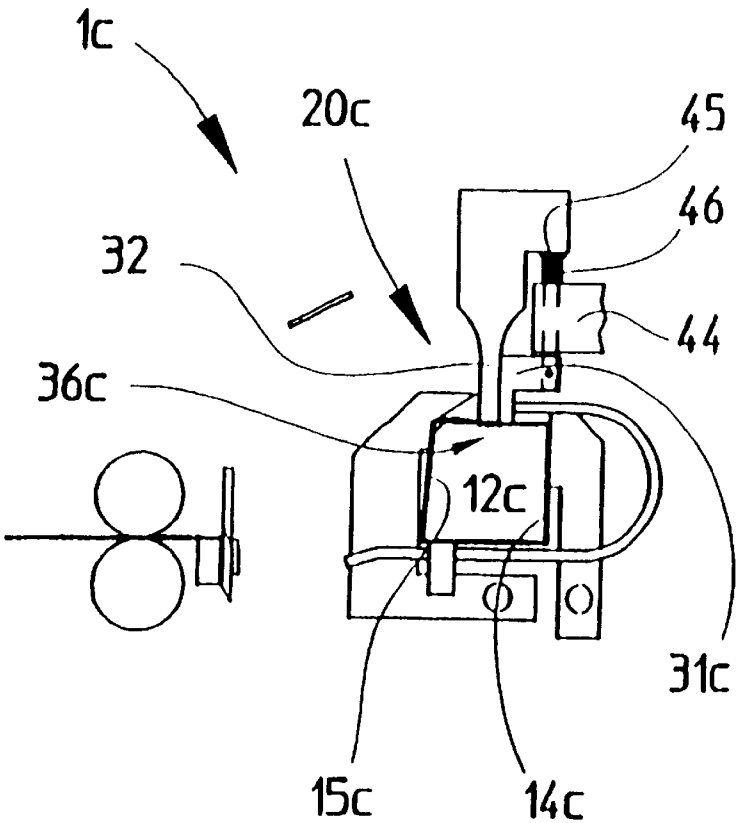

In FIG. 13*f,* the apparatus 1*c* is illustrated with the bending apparatus 5*c* completely closed and the pressing unit 20*c* lowered. The hollow item 15*c* with a folded-over central seam is closed around the mandrel 12*c,* and the longitudinal seam 36*c* can be welded in the process step illustrated.

FIG. 13*g* shows a detail from FIG. 13*f* with the region around the longitudinal seam 36*c* arranged in the central region. Here it is clear how the comb part 31*c* lowered in front of the welding tool 32 serves as a stop for the second longitudinal edge 35 and thus guides the latter into a precisely predetermined position. Moreover, the comb part 31*c* holds the leading part of the blank 14*c* pressed down on the mandrel 12*c,* so that, by lowering the welding tool 32, the first longitudinal edge 33*c* is placed with the folded-over additional longitudinal edge 34*c* below the second longitudinal edge 35, and this construction can be welded after it has been squeezed together.

With the apparatus 1*c* described, by exchanging the cutting unit 4*c* with the cutting unit 4*a* from FIG. 10 and connecting the comb part 31*c* to the welding tool 32 in a similar way to the manner illustrated in FIG. 1, a hollow item can also be produced, which has a simple seam which is not folded over in its central region.

What is claimed is:

1. Apparatus for producing tubular hollow items, in particular for containers, from card material, having a conveying unit (3) for transportation and for the positioning of a web (2) or a blank (22), a cutting unit (4) for separating defined blanks (22) from the web (2) in the case of the material being supplied in the form of a web, a bending station (5) for prebending a blank (22) or the web (2) during the insertion and further the bending station (5) bending the blank (22) , which is fixed in position, around a mandrel (12) to form the finished, tubular hollow item (15) with open end faces, a presser (21) is arranged at a point on the mandrel (12) located in such a way that the blank (22) is lifted up and, if appropriate, is pressed by a third side against the mandrel (12) to fix it in position, such that a passage (37) for inserting the next blank (22) is formed below the mandrel (12) and a pressing unit (20) for connection in an overlap region (29) of the blank (22) with welding a folding element to form a longitudinal edge (34) that is placed between first and second longitudinal edges (33, 35) of the blank (22) to form a three layer construction in the overlap region (29) before connection of the first and second longitudinal edges (33, 35), a sliding unit (28) for the further transport of the finally shaped hollow item (15).

2. Apparatus according to claim 1, characterised in that the conveying unit (3) for transporting the web (2) or the blank (22) comprises a roll or roller drive, as a combination of a spring-loaded nipping roll (6) and a driven roller (7), between which the web (2) or the blank (22) runs.

3. Apparatus according to claim 1, characterised in that an insertion aid (11) is movable between a position of readiness and at least one position outside the insertion point, in particular in pivotable on a circular path between the said positions.

4. Apparatus according to claim 1, characterised in that the bending station (5) comprises fixed guide elements which act as a bending apparatus, have at least one curved section and are preferably configured as guide rails (13), arranged spaced apart parallel to one another, for prebending the web (2) or a blank (22) while it is being inserted.

5. Apparatus according to claim 1, characterised in that a shaping body or a mandrel (12) is arranged in the bending station (5), against which the blank (22) is placed until, by bending and folding at least in sections by means of bending tools (16, 17), it achieves the shape of a hollow item.

6. Apparatus according to claim 5, characterised in that the cross-sectional profile of the mandrel (12) lies within the cross-section of the hollow body (15) to be, produced, and the generating lines of the cross-sections come into contact at the places, where the blank (22) is placed against the mandrel (12).

7. Apparatus according to claim 1, characterised in that the bending station (5) comprises at least one movable, first bending tool (17) which takes over the bending of the front section of the blank (22) and folds a first side of the blank (22) and moves it into a predetermined position in relation to the mandrel (12) and, if appropriate, places the first side against the mandrel (12).

8. Apparatus according to one of claim 1, characterised in that the bending tool (17) is of finger-like configuration and, for bending and/or folding, engages in the gaps between adjacent guide rails (13).

9. Apparatus according to claim 1, characterised in that the bending station (5) comprises at least one second, movable bending tool (16) which is located opposite the first tool and bends a second side of the blank (22), located opposite the first side, in a predetermined manner.

10. Apparatus according to claim 1, characterised in that the cutting unit (4) comprises a fixed bottom cutter (9) and a movable top cutter (8), one part of the apparatus being located with a folding edge (10)

opposite the top cutter (8) to produce an additional longitudinal edge (34) and the bottom cutter (9) and the folding edge (10) receiving the top cutter (8) between them at the end of the cutting operation.

11. Apparatus according to claim 10, characterised in that the width of the prefolded, additional longitudinal edge (34) essentially corresponds to the width of a cross-sectional area of the top cutter (8) located perpendicular to the cutting direction and above the cutting surface and is adjustable, in particular, by this means.

12. Apparatus according to claim 10, characterised in that the folding edge (10) is arranged on the second bending tool (16) which is moved between the position on the cutting unit (4) and the bending or folding positions.

13. Apparatus according to claim 9, characterised in that the second bending tool (16) has a sloping folding edge (10*b*) for prefolding the first longitudinal edge (33) on the mandrel (12).

14. Apparatus according to claims 9, characterised in that the second bending tool (16) is assigned a folding element which places the first longitudinal edge (33) against the mandrel (12) in the immediate vicinity of the mandrel edge, the folding element preferably being a constituent part of the pressing unit (20).

15. Apparatus according to claim 14 characterised in that the folding element is configured as a folding comb (10) and, when the first longitudinal edge (33) is placed against the mandrel (12), is guided in corresponding grooves in the second bending tool (16).

16. Apparatus according to claim 5, characterised in that the pressing unit (20) comprises a pressing rams which, to place the first longitudinal edge (33) against the mandrel (12) is lowered on to the latter.

17. Apparatus according to claim 5, characterised in that the folding comb (10, 10*a*) is mounted on the pressing unit (20) so as to be relatively movable in such a way that it rests on the first longitudinal edge (33) before the pressing ram.

18. Apparatus according to claim 16, characterised in that the pressing ram is configured as a welding tool (32) and one part of the mandrel (12) is configured as an anvil (30).

19. Apparatus according to claim 18, characterised in that, at the end of the bending and folding operation, the overlap region (29) is pressed on to the anvil (30) by the pressing unit (20) and is welded either in sections or already in a sealing manner by the welding tool (32).

20. Apparatus according to claim 1, characterised in that the overlap region (29) is formed in a central region or in the region of a later edge of the hollow item and is pressed between a multipart pressing unit (20*c*) and a mandrel (12*c*) and is welded at least in sections.

* * * * *